US011267680B2

(12) United States Patent
Nguyen

(10) Patent No.: US 11,267,680 B2
(45) Date of Patent: Mar. 8, 2022

(54) CLAMPING DEVICE FOR LIFTING AND TRANSFER OBJECTS

(71) Applicant: Nhon Hoa Nguyen, Bankstown (AU)

(72) Inventor: Nhon Hoa Nguyen, Bankstown (AU)

( * ) Notice: Subject to any disclaimer, the term of this patent is extended or adjusted under 35 U.S.C. 154(b) by 0 days.

(21) Appl. No.: 17/317,065

(22) Filed: May 11, 2021

(65) Prior Publication Data

US 2021/0347612 A1 Nov. 11, 2021

Related U.S. Application Data

(60) Provisional application No. 63/022,724, filed on May 11, 2020.

(51) Int. Cl.

| | |
|---|---|
| ***B25B 5/00*** | (2006.01) |
| ***B66C 1/48*** | (2006.01) |
| ***B25B 5/16*** | (2006.01) |
| ***B25B 5/14*** | (2006.01) |
| ***B25B 5/02*** | (2006.01) |

(52) U.S. Cl.

CPC ..... *B66C 1/48* (2013.01); *B25B 5/02* (2013.01); *B25B 5/145* (2013.01); *B25B 5/163* (2013.01)

(58) Field of Classification Search

CPC .... B25B 1/00; B25B 3/00; B25B 5/00; B25B 7/00; B25B 11/00; B23Q 3/00

See application file for complete search history.

(56) References Cited

U.S. PATENT DOCUMENTS

| | | | | |
|---|---|---|---|---|
| 6,298,896 | B1 * | 10/2001 | Sherrill | B29C 43/56 156/581 |
| 7,290,761 | B2 * | 11/2007 | Siegel | B25B 1/08 269/266 |
| 9,004,476 | B2 * | 4/2015 | Schmidt | B25B 1/2457 269/282 |
| 2013/0277903 | A1 * | 10/2013 | Gray | B25B 1/2405 269/282 |

* cited by examiner

*Primary Examiner* — Lee D Wilson

(74) *Attorney, Agent, or Firm* — Tue Nguyen

(57) ABSTRACT

Attachments for a clamping device can be used to increase the contact area between the jaws and the object to allow the clamping device to handle irregular objects, such as non-flat panels of metal, granite, ceramic, glass, quartz, or concrete plates. The attachments can include plate assemblies to be attached to the sides of the irregular objects. The attachments can include jaw plate assemblies to be attached to the sides of the jaws of the clamping device.

19 Claims, 39 Drawing Sheets

Mounting a plate assembly to a surface of an object to provide a surface adequate for clamping
400

FIG. 4A

Mounting a plate assembly to a jaw of a clamping device to provide a surface adequate for clamping on an object
420

FIG. 4B

Mounting a plate assembly to a first surface of an object to provide a surface on the object adequate for clamping, and mounting a plate assembly to a jaw of a clamping device to provide a surface on the jaw adequate for clamping on a second surface of the object
440

FIG. 4C

Forming a plate assembly, wherein the plate assembly comprises a plate coupled to a mounting feature through a moving mechanism, wherein the mounting feature is configured to be mounted on an object so that the plate is parallel to a surface of the object, wherein the moving mechanism is configured to move the plate in a direction parallel to the surface and in a direction perpendicular to the surface, Wherein the moving mechanism comprises a rod sliding in a guide,
Wherein the moving mechanism comprises an antirotation feature,
Wherein the plate comprises a feature to increase the thickness of the plate,
Wherein the thickness-increase feature comprises multiple pins configured to mount another plate.
1400

*FIG. 14A*

Mounting a plate assembly on an object.
1420

↓

Adjusting the plate to contact surfaces of the object.
1430

↓

Adding another plate to the plate assembly so that the total thickness is larger than the thickness of the object.
1440

*FIG. 14B*

Forming a plate assembly, wherein the plate assembly comprises a plate coupled to a mounting feature through a moving mechanism, Wherein the plate comprises a compressible material.
1600

FIG. 16A

Forming a plate assembly, wherein the plate assembly comprises a plate coupled to a mounting feature through a moving mechanism, Wherein the plate comprises a feature to increase the thickness of the plate by mounting a second plate next to the plate,
Wherein the second plate comprises a compressible material.
1620

FIG. 16B

Mounting a plate assembly on an object, wherein the plate of the plate assembly comprises a compressible material, wherein the thickness of the plate is larger than that of an object, wherein the maximum compressed amount of the plate is larger than a difference between the plate thickness and a thickest portion of the object
1640

FIG. 16C

Mounting a plate on a plate assembly, wherein the plate comprises a compressible material, wherein the total thickness of the plate and the plate assembly is larger than that of an object, wherein the maximum compressed amount of the plate is larger than a difference between the total thickness and a thickest portion of the object
1660

FIG. 16D

Forming a plate assembly, wherein the plate assembly comprises a plate coupled to a mounting feature, wherein the mounting feature is configured to be mounted on a jaw of a clamping device configured to clamp on an object, Wherein the mounting feature is configured to be coupled to sides of the jaw.
2600

*FIG. 26A*

Mounting one or two plate assembles on one or two jaws of a clamping device for clamping on an object.
2620

*FIG. 26B*

Mounting a first plate assembly on an object.
2640

↓

Mounting a second plate assembly on a jaw of a clamping device for clamping on an object.
2650

↓

Lowering the clamping device on the object for clamping
2660

*FIG. 26C*

Forming a plate assembly to be mounted on a jaw of a clamping device, wherein the plate assembly is secured on one or two sides of the jaw.

Wherein the plate assembly is secured by screw bolts to a side of the jaw.
Wherein the plate assembly is secured by a pin sliding in a spiral path to advance a rod against the side of the jaw.
Wherein the plate assembly is secured by a spring action.
Wherein the plate assembly is secured by a combination of a coarse movement and a fine movement.
Wherein the plate assembly is secured by a combination of a spring action and a screw action.
2800

*FIG. 28A*

Releasing a secure mechanism on a plate assembly.
2820

↓

Mounting the plate assembly on a jaw.
2830

↓

Activating the securing mechanism, in a coarse movement, to secure the plate assembly to the jaw.
2840

↓

Activating the securing mechanism, in a fine movement, to secure the plate assembly to the jaw.
2850

*FIG. 28B*

Forming a plate assembly, wherein the plate assembly comprises a plate coupled to a mounting feature, wherein the mounting feature is configured to be mounted on a jaw of a clamping device configured to clamp on an object, wherein the plate is extended outside the jaw surface, wherein the extended portion of the plate is configured to accept one or more plates.

Wherein the extended portion comprises multiple pins protruded toward the jaw or multiple holes,
Wherein the one or more plates each comprises matching holes to be mated to the multiple pins or matching pins for the holes.
3500

*FIG. 35A*

Mounting a plate assembly on a jaw of a clamping device for clamping on an object.
3520

↓

Adding one or more plates to the plate assembly to increase a thickness to match with the thickness of the object
3530

*FIG. 35B*

Determining a thickness on an object for clamping
3550

↓

Mounting one or more plates on a plate assembly to match the thickness.
3560

↓

Mounting the plate assembly on a jaw of a clamping device.
3570

*FIG. 35C*

Coupling a plate to a plate assembly,
Wherein the coupling comprises one or more pins on the plate through corresponded holes in the plate assembly,
Wherein the coupling comprises one or more bolts on the plate through corresponded holes in the plate assembly with secured nuts,
Wherein the coupling comprises one or more hooks on the plate through corresponded receptacles in the plate assembly,
Wherein the coupling comprises magnet layers on the plate adhering to corresponded iron layers on the plate assembly.
3700

*FIG. 37A*

Coupling a plate to a plate assembly to be coupled to a jaw of a clamping device or to an object, wherein the plate assembly comprises a plate, wherein the plate comprises a compressible material.
3720

*FIG. 37B*

Coupling a plate to a plate assembly, wherein the plate comprises a compressible material.
3740

*FIG. 37C*

Modifying a jaw of a clamping device for coupling with a plate assembly,

Wherein the modification comprises forming multiple holes in a side of the jaw,
Wherein the modification comprises forming multiple pins in a side of the jaw
3900

*FIG. 39A*

Forming a clamping device comprising a jaw having a coupling feature for coupling with a plate assembly, Wherein the coupling feature comprises multiple holes in a side of the jaw,
Wherein the coupling feature comprises multiple pins in a side of the jaw
3920

*FIG. 39B*

Forming a clamping device and an add-on feature comprising a plate assembly, wherein the plate assembly is configured to be coupled to a jaw of the clamping device, Wherein the plate assembly comprises multiple holes in a side or in a face of a plate of the plate assembly,
Wherein the plate assembly comprises multiple pins in a side or in a face of a plate of the plate assembly.
3940

*FIG. 39C*

CLAMPING DEVICE FOR LIFTING AND TRANSFER OBJECTS

The present application claims priority from U.S. provisional Patent Application Ser. No. 63/022,724, filed on May 11, 2020, hereby incorporated by reference in its entirety.

The present invention relates to lifting devices. More particularly, it relates to clamping devices for lifting and transferring objects such as metal or ceramic plates.

BACKGROUND

In the heavy industry, large and heavy products can be difficult to handle manually. Thus, a hoist connecting to a clamping device can be used to lift and move heavy objects. An object can be clamped to a clamping device that is coupled to a hoist. The hoist can lift the object to a certain height, and then transfer to a proper location.

The clamping devices can utilize a mechanism that converts the weight of the object into a clamping force, thus the holding force on the object exerted by the clamping devices can be proportional to the weight of the object. A loading and unloading device, such as a crane or a hoist, can be coupled to the clamping device for lifting and transferring the objects.

A compact clamping device can have two opposite facing flat jaws connected through a clamp bar. As such, the clamping device is configured to handle flat panels.

FIGS. 1A-1B illustrate a compact clamping device configured to handle flat panels. In FIG. 1A, a clamping device 100 can have a first jaw 101 disposed facing a second jaw 102. The two jaws are connected through a clamp bar. When the clamping device is lifted up, a moving mechanism can be asserted on a portion of a jaw, such as on jaw 101, to shorten the space between the two jaws, such as by moving the jaws together, in effect clamping on a flat panel 103 placed between the two jaws. The clamping device 100 can be compact, with the jaws and the clamp bar disposed surrounding the flat panel.

The compactness of the clamping device 100 can make it difficult to handle non-flat panels, such as non-flat panels, or panels having a higher thickness at an edge portion, such as turndown edge slabs, mitered edge countertops, backsplash countertops, or panels with edge trim. As shown in FIG. 1B, a non-flat panel 105 can be a flat panel with raised edge portions. For example, a panel can have a flat surface 108 at a portion of the panel, and a raised edge surface 107 at the panel edge, e.g., the edge thickness can be raised 106 from the surface 108 of the panel. As shown, the raised edge portions can be on both sides of a flat panel, e.g., a panel having two parallel opposite flat surfaces, with additional materials at both flat surfaces at the edge.

In general, there is a need for a compact clamping device to handle irregular or non-flat panels, since the parallel configuration of the clamping jaws can prevent a good grip on the irregular or non-flat panels.

SUMMARY

In some embodiments, the present invention discloses attachments for a clamping device to allow the clamping device to handle irregular objects, such as non-flat panels of metal, granite, ceramic, glass, quartz, or concrete plates.

The attachments can be used to increase the contact area between the jaws and the object, e.g., providing flat surface area on the object or on the jaws. In some embodiments, the attachments can include one or more object plate assemblies to be attached to the sides of the irregular objects to provide flat surfaces for the flat jaws of the clamping device to grip. In some embodiments, the attachments can include one or more jaw plate assemblies to be attached to the sides of the jaws of the clamping device to provide spaces for the protruded portions of the irregular objects when the clamping device clamps on the objects.

BRIEF DESCRIPTION OF THE DRAWINGS

FIGS. 4A-4C illustrate flow charts for processes of clamping panels according to some embodiments.

FIGS. 14A-14B illustrate flow charts for a plate assembly according to some embodiments.

FIGS. 16A-16D illustrate flow charts for compressible plate according to some embodiments.

FIGS. 26A-26C illustrate flow charts for plate assemblies at jaws of a clamping device according to some embodiments.

FIGS. 28A-28B illustrate flow charts for plate assembly on a jaw according to some embodiments.

FIGS. 35A-35C illustrate flow charts for configurations of plate assemblies according to some embodiments.

FIGS. 37A-37C illustrate flow charts for configurations of plate assemblies according to some embodiments.

FIGS. 39A-39C illustrate flow charts for configurations of a clamping device according to some embodiments.

DETAILED DESCRIPTION OF THE EMBODIMENTS

In some embodiments, the present invention discloses add-on components for a clamping device to allow the clamping device to handle irregular objects, such as non-flat panels of metal, granite, ceramic, glass, quartz, or concrete plates.

The clamping device can be a compact clamping device, having a jaw movable along a clamp bar to be closer to an opposite jaw for clamping on an object. An irregular object can have protruded elements from its surface, which can reduce the contact area with the jaws. With inadequate contact area, the clamping device might not be able to exert sufficient forces on the object to keep the object within the jaws when lifting.

The add-on components can be used to increase the contact area between the jaws and the object, e.g., providing flat surface area on the object or on the jaws. In some embodiments, the add-on components can include one or more object plate assemblies to be attached to the sides of the irregular objects to provide flat surfaces for the flat jaws of the clamping device to grip. The add-on components can include one or more jaw plate assemblies to be attached to the sides of the jaws of the clamping device to provide spaces for the protruded portions of the irregular objects when the clamping device clamps on the objects.

Figure 1A:
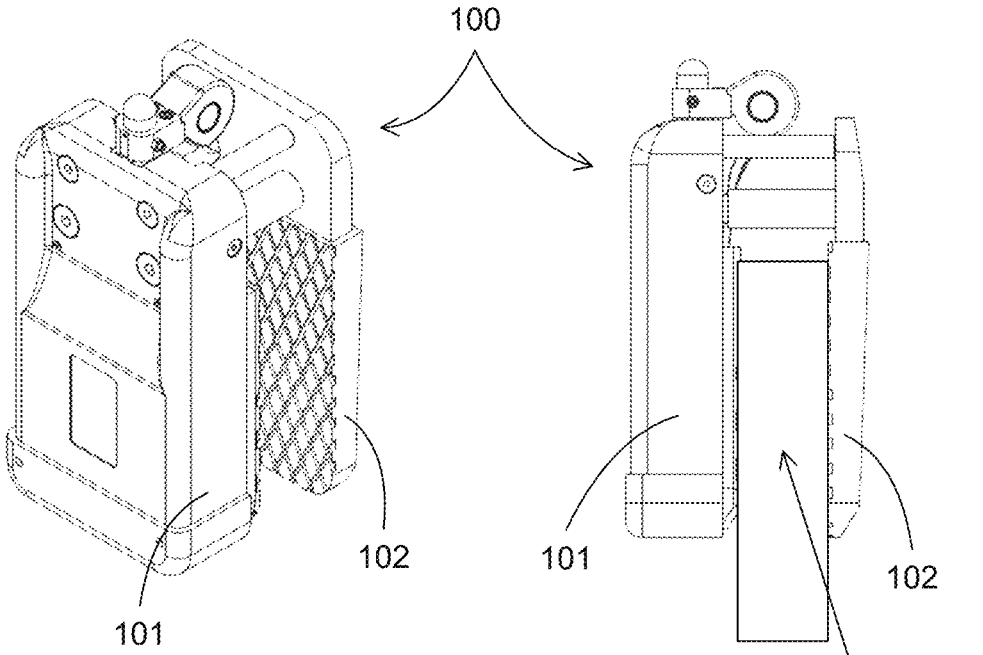
FIGS. 1A-1B illustrate a compact clamping device configured to handle flat panels.
Figure 1B:
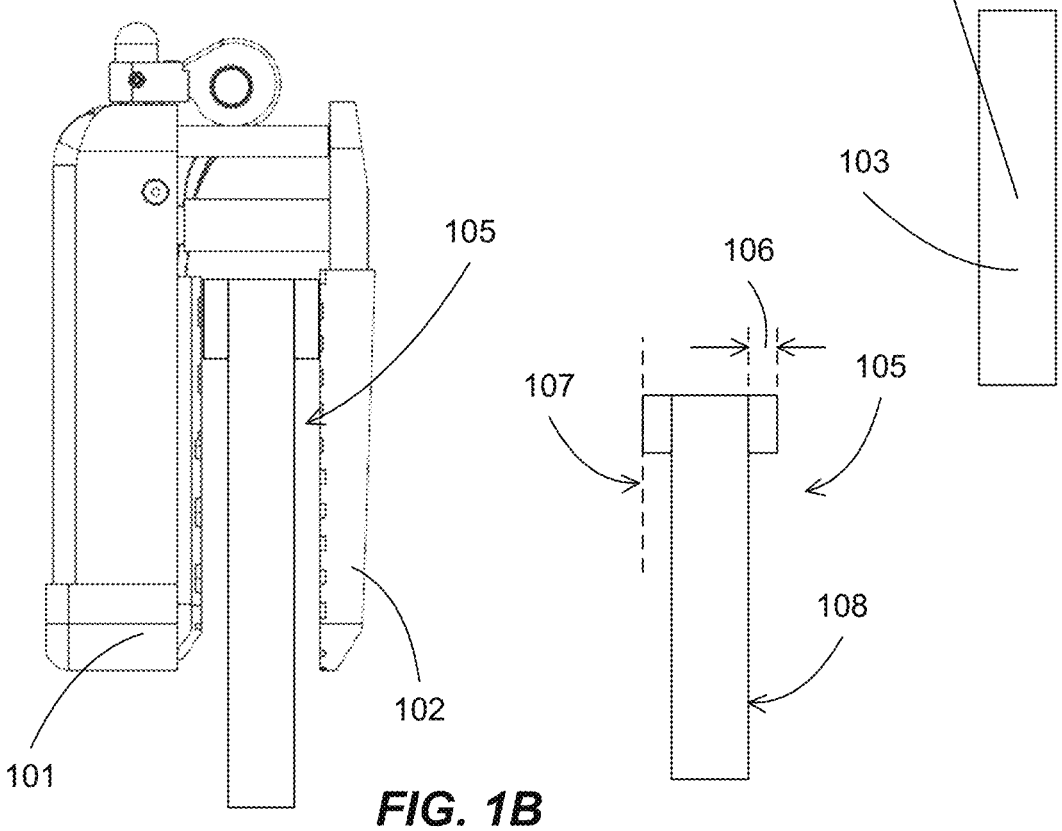
Figure 2A:
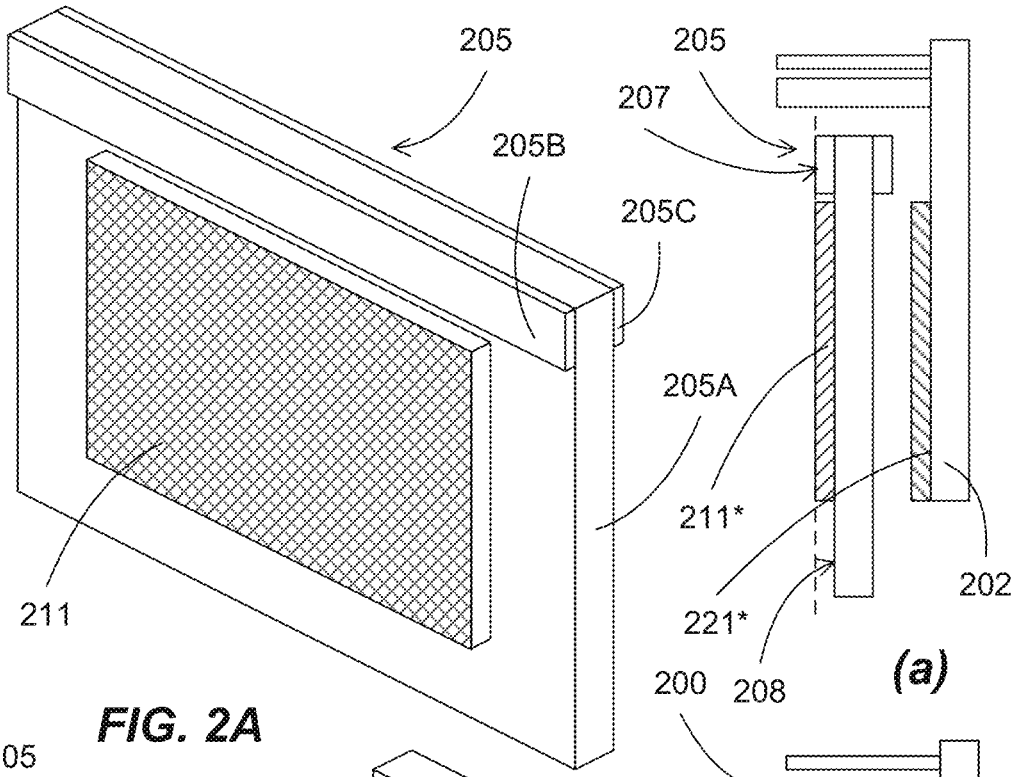
FIGS. 2A-2C illustrate add-on plates for a clamping device according to some embodiments.
Figure 2B:
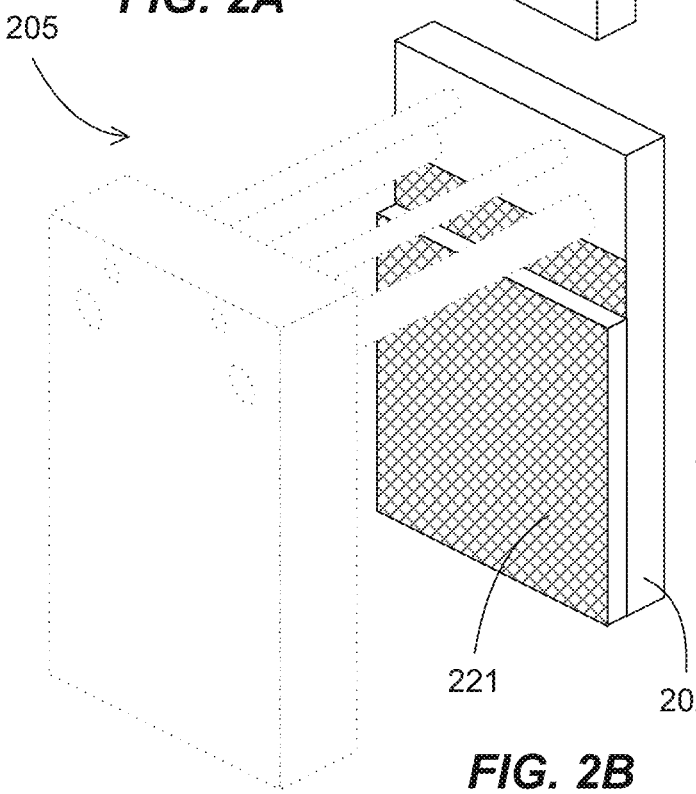
Figure 2C:
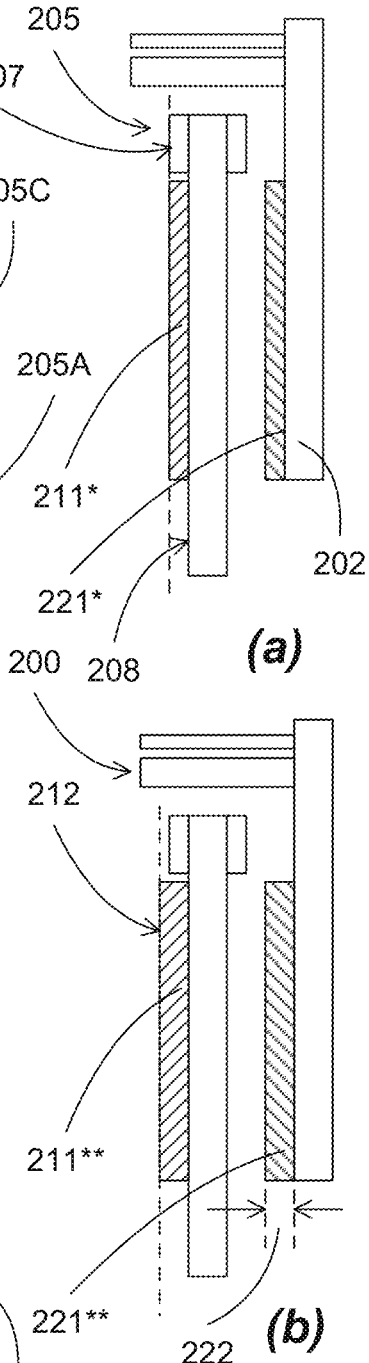

FIGS. 2A-2C illustrate add-on plates for a clamping device according to some embodiments. In FIG. 2A, a plate 211 can be mounted on a non-flat panel 205, such as a flat board 205A having a left raised edge portion 205B and a right raised edge portion 205C. The raised edge portions 205B and 205C can be trims added to the board 205A, or can be edge portions to increase an appearance of thickness to the board 205A.

For the non-flat panel 205, a clamping device can clamp on the raised edge portions 205B and 205C, since these edge portions present a highest thickness for the panel 205. The small areas provided by the raised edge portions can be inadequate for surface contact area required to lift a heavy panel, such as stone slabs.

In some embodiments, a plate 211 can be added to the flat portion of the non-flat panel, such as added to the flat portion of the board 205A. The thickness of the plate 211 can be equal (plate 211*) to or larger (plate 211) than the raised edge 205B or 205C, in order for the clamping jaw to contact the plate 211. For example, the thickness of the added plate 211 should be equal or larger the difference between the surface plane 207 of the raised edge and the surface plane 208 of the flat portion 208** of the non-flat panel. Multiple plates can be stacked up to achieve the desired thickness.

In FIG. 2B, a plate 221 can be mounted on a jaw 202 of a clamping device 205. The plate 221 can be added to the jaw 202 to ensure that the jaw can contact a large surface area of the non-flat panel, such as contacting the flat portion 208 of the panel. Similar to the plate 211, the plate 221 can have a thickness 222 equal (plate 221*) to or larger (plate 221) than the thickness of the raised edge 205B or 205C, in order for the clamping jaw (with the mounted plate 221) to contact the panel 205**.

Figure 3:
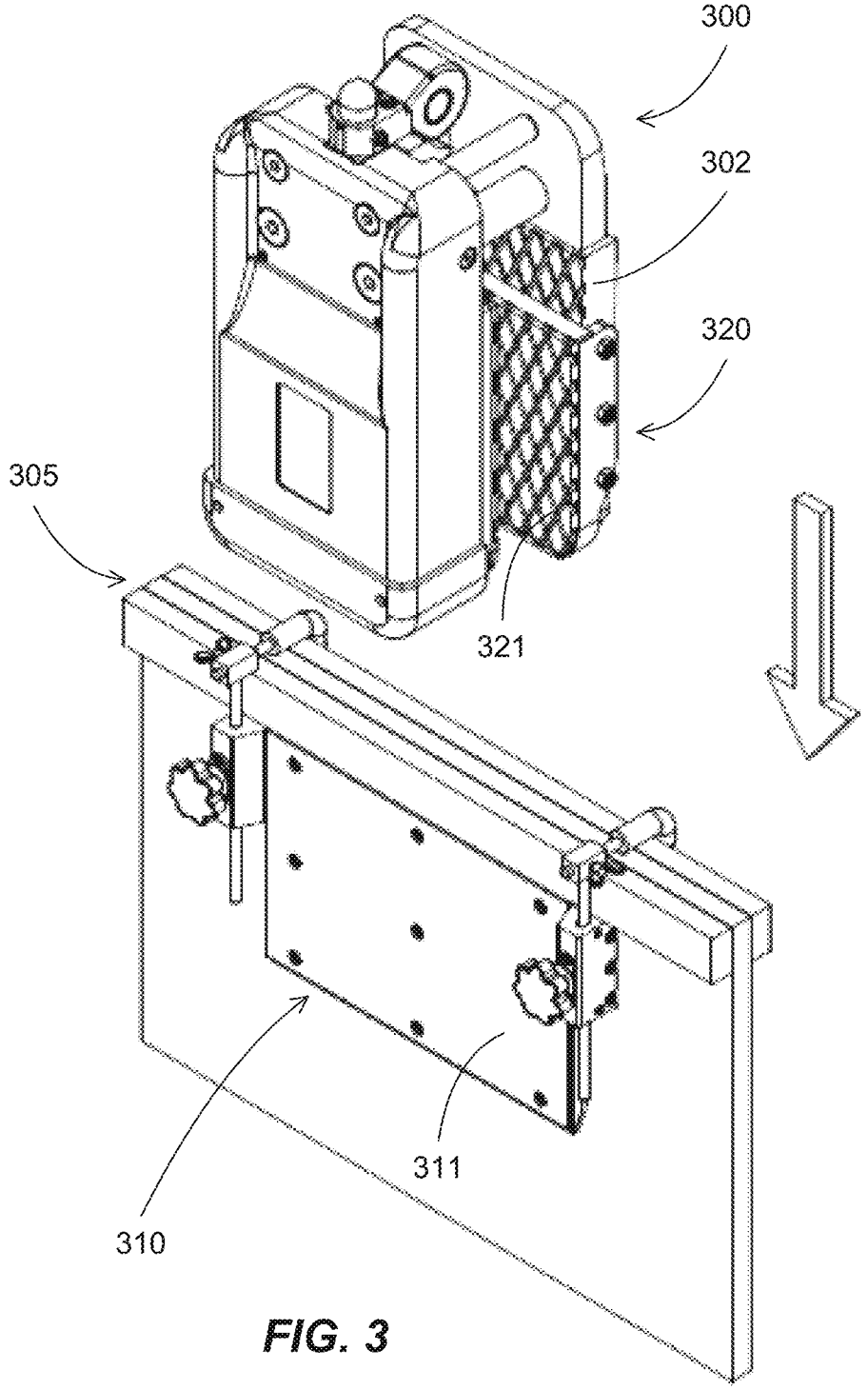
FIG. 3 illustrates a configuration of add-on plates on plate assemblies according to some embodiments

FIG. 3 illustrates a configuration of add-on plates on plate assemblies according to some embodiments. An object plate assembly 310, including a plate 311, can be mounted on a panel 305, so that the plate 311 is added to the flat portion of the panel 305. The surface area of the plate 311 can be larger than the area of the jaw of the clamping device, to maximize the contact surface.

A jaw plate assembly 320, including a plate 321, can be mounted on a jaw 302, so that the plate 321 is added to the surface of the jaw 302 of the clamping device 300. The clamping device can be lowered on the panel 305 for clamping with the contact surfaces on the added plates 311 and 321.

FIGS. 4A-4C illustrate flow charts for processes of clamping panels according to some embodiments. In FIG. 4A, operation 400 mounts a plate assembly to a surface of an object to provide a surface adequate for clamping. The plate assembly can include a plate in contact with a large flat surface of the object. The thickness of the plate can be larger than the raised portion of the object, for the clamping device to contact the plate instead of contacting the object.

In FIG. 4B, operation 420 mounts a plate assembly to a jaw of a clamping device to provide a surface adequate for clamping on an object. The plate assembly can include a plate in contact with the surface of a jaw of the clamping device. The thickness of the plate can be larger than the raised portion of the object, for the clamping device to contact the plate instead of contacting the object.

In FIG. 4C, operation 440 mounts a plate assembly to a first surface of an object to provide a surface on the object adequate for clamping, and also mounts a plate assembly to a jaw of a clamping device to provide a surface on the jaw adequate for clamping on a second surface of the object.

In some embodiments, the present invention discloses an add-on plate assembly for an object, such as an irregular panel or a panel with non-parallel surfaces with non-flat surfaces. The add-on plate assembly can be mounted to the object, so that the object can be clamped and lifted using a clamping device.

The plate assembly can include a plate to provide a raised surface for the clamping device to clamp on. Since the clamping device includes clamping jaws that clamp on the highest surface portion of the object, the plate can be used to provide a large raised area for the clamping device. For example, for objects having a large recessed surface area, the plate can be added to the recessed area to raise the height of the recessed surface of the objects.

The plate can have a mounting feature for another plate, e.g., for another plate to be attached to the plate to increase the thickness of the plate. Since the thickness of the plate should be higher than the deepest recess of the object, additional plates can be mounted to the plate of the plate assembly to provide an adequate thickness for the plate assembly.

The add-on plate assembly can include a mounting feature for mounting on the object, such as to mount on a top edge of the object. The mounting feature can include a bar for placing on the object, together with optional one or two side portions for clamping on the object. The plate assembly can include a xy moving mechanism coupled to the mounting feature and to the plate for moving the plate relative to the object. For example, the xy moving mechanism can include a linear guide assembly disposed perpendicular to a surface of the object, which can have a linear guide rail, such as a rod, for a linear bearing or a linear bushing sliding along the rod. The perpendicular linear guide can allow movement of the plate toward or away from the object, e.g., in a direction perpendicular to the clamped surface of the object.

The xy moving mechanism can include a linear guide assembly disposed parallel to the surface of the object, which can have a linear guide rail, such as a rod, for a linear bearing sliding along the rod. The parallel linear guide can allow movement of the plate toward or away from an edge of the object, so that the plate can be located closer to the jaws of the clamping device.

Figure 5:
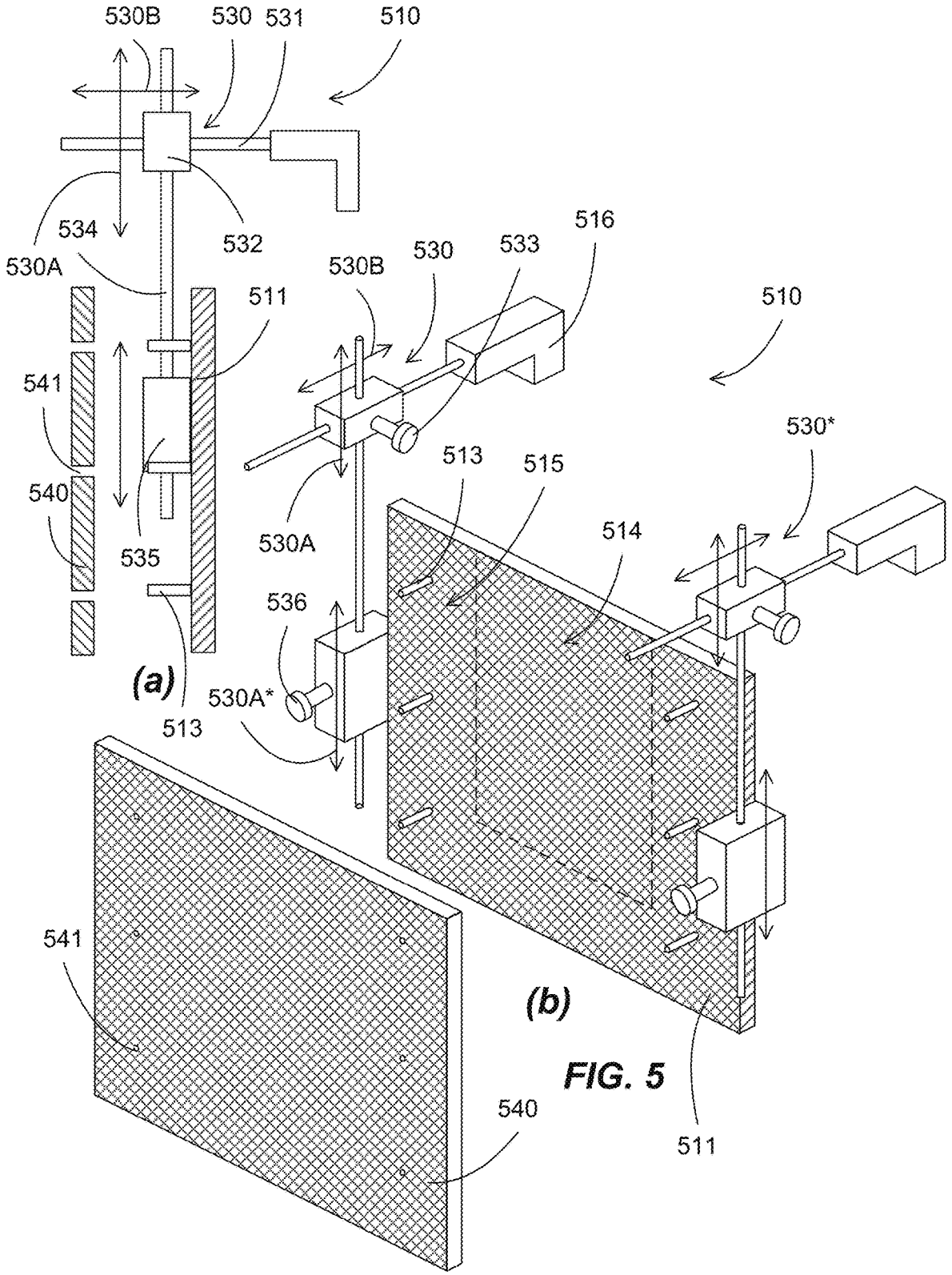
FIG. 5 illustrates a plate assembly for mounting on an object according to some embodiments.

FIG. 5 illustrates a plate assembly for mounting on an object according to some embodiments. A plate assembly 510 can include a plate 511 coupled to a xy linear movement mechanism 530 that can allow the plate to move in a direction 530A parallel to the object and in a direction 530B perpendicular to the object. For example, the xy linear movement mechanism can include a perpendicular linear guide assembly that can move the plate in a direction 530B perpendicular to the object. The perpendicular linear guide assembly can include a linear bearing 532 which can slide along a linear guide rail such as a rod 531. A perpendicular locking mechanism, such as a lock screw 533, can be used to secure the linear bearing 532 to the rod 531, to prevent the plate 511 to move in the perpendicular direction 530B.

The plate 511 can be larger than a surface of the jaw, which can be shown as surface 514. The clamped surface 514 should be flat and free of obstacles to be clamped by the jaw of the clamping device. The outside area 515 of the plate, e.g., the area outside the clamping area, is not configured to be clamped. The plate 511 can include a mounting feature, such as multiple pins 513 at the outside area 515, which can allow attaching another plate 540 having mating holes 541. Other mounting features can be used, such as by using magnetic materials. For example, one or more magnet materials could be placed in the plate 511 and the other plate 540, and configured to be attractive to each other. A permanent magnetic material, e.g., a magnet, can be placed in one plate, such as plate 511, and a magnetic material can be placed in the other plate, such as plate 540. The two plates can be adhered to each other due to the magnetic force exerted by the magnet on the magnetic material.

The xy linear movement mechanism can include a parallel linear guide assembly that can move the plate in a direction 530A parallel to the object. The parallel linear guide assembly can use the same bearing block 532 having another track for a linear guide rail, such as a rod 534. Thus, the linear bearing block 532 can slide along the rod 531 in the perpendicular direction 530B and can slide along the rod 534 in the parallel direction 530A. Alternatively, the parallel linear guide assembly can include another linear bearing 535 which can slide along a linear guide rail such as a rod 534. The rod 534 can be fixedly coupled to the linear bearing 532, and thus, when the linear bearing 532 moves along the perpendicular rod 531, the parallel rod 534 moves together with the linear bearing 532. A parallel locking mechanism, such as a lock screw 536, can be used to secure the linear bearing 535 to the rod 534, to prevent the plate 511 to move in the parallel direction 530A.

The linear bearing 535 can be coupled to the plate 511, so that the plate moves in xy directions, e.g., parallel and perpendicular to the plane of the object.

The xy linear movement mechanism 530 can include a mounting feature 516, which can be used to attach the xy linear movement mechanism to the object, such as attach to a top edge of the object.

In some embodiments, the xy movement mechanism can include an antirotation feature to prevent the plate from rotating from the parallel direction, e.g., the antirotation feature only allow the plate to move in parallel and perpendicular directions while remaining parallel to the object. The antirotation feature can be used on the parallel movements, since the movements of the linear bearings 535 on two edges of the plate 511 need to be coordinated. For example, the independent movements of the linear bearings 535 can cause the plate to rotate from the parallel plane.

Figures 6A, 6B, 6C:
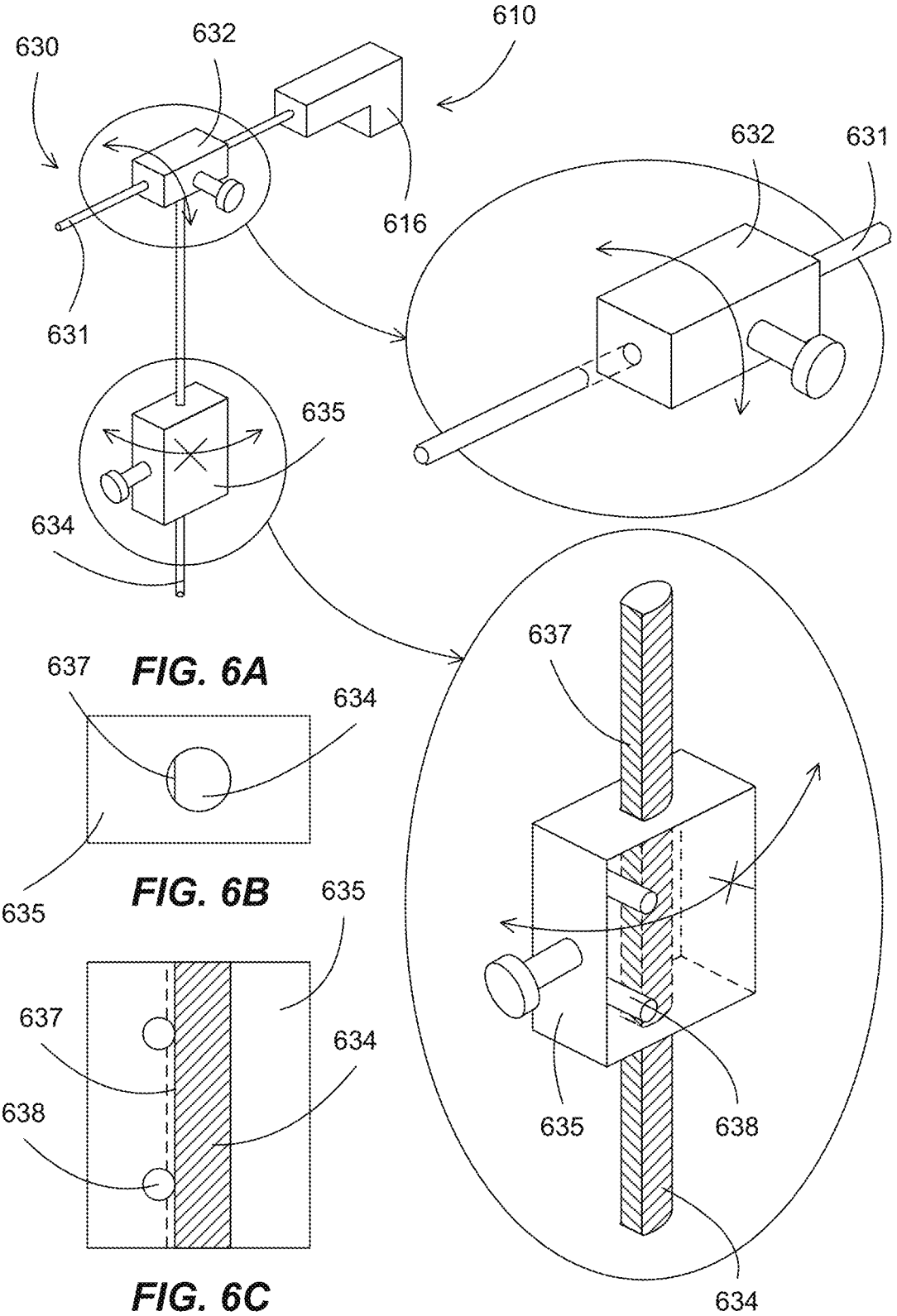
FIGS. 6A-6C illustrate an antirotation feature of a xy movement mechanism according to some embodiments.

FIGS. 6A-6C illustrate an antirotation feature of a xy movement mechanism according to some embodiments. A plate assembly 610 can have a xy movement mechanism 630 with a perpendicular movement having a linear bearing 632 sliding along a rod 631, and a parallel movement having a linear bearing 635 sliding along a rod 634. The linear bearing 632 can be fixed coupled to the rod 634. The perpendicular movement can allow a rotation of the linear bearing 632 around the rod 631.

The parallel movement can have an antirotation feature, which can prevent the linear bearing 645 from rotate around the rod 634. For example, the linear bearing 635 can include a through hole passing the linear bearing. The rod 634 can have a circular cross section with a cut 637 along the axis of rotation of the rod. Screws 638 can be put at locations of the cut 637, and thus can prevent the rod 634 from rotating.

Other configurations for the antirotation feature can be used, such as an elliptical cross section rod, or a rod with a trench along the rotational axis instead of a cut.

Figure 7A:
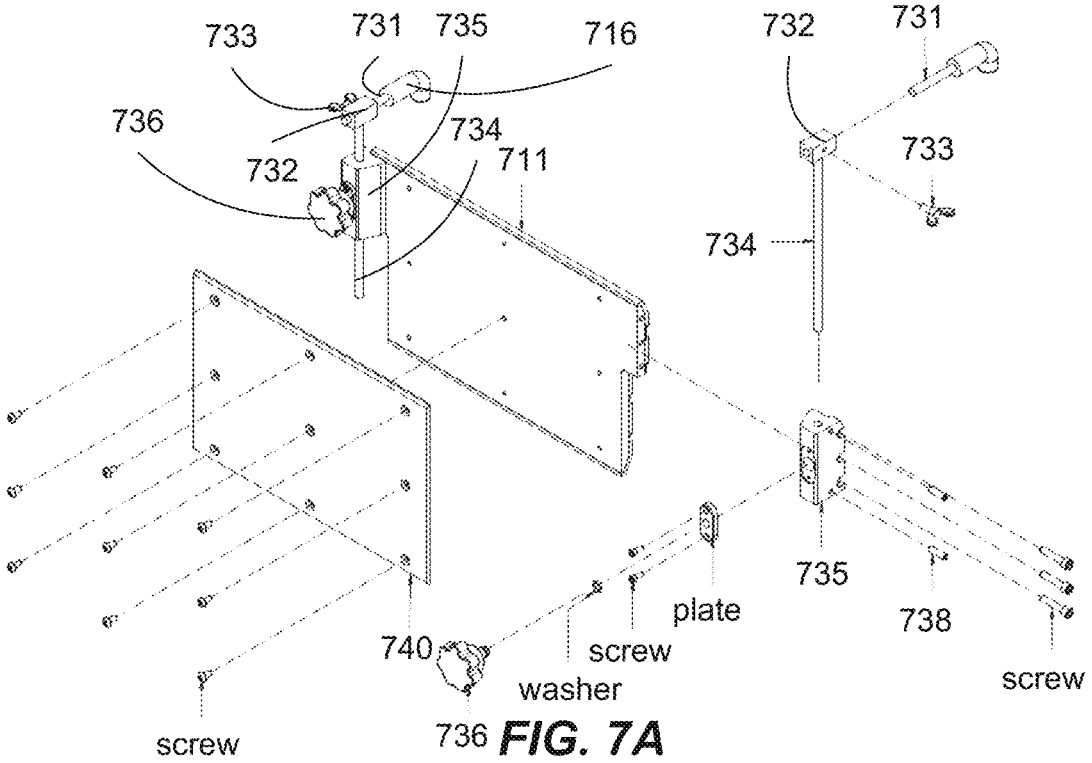
FIGS. 7A-7B illustrate a plate assembly according to some embodiments.
Figure 7B:
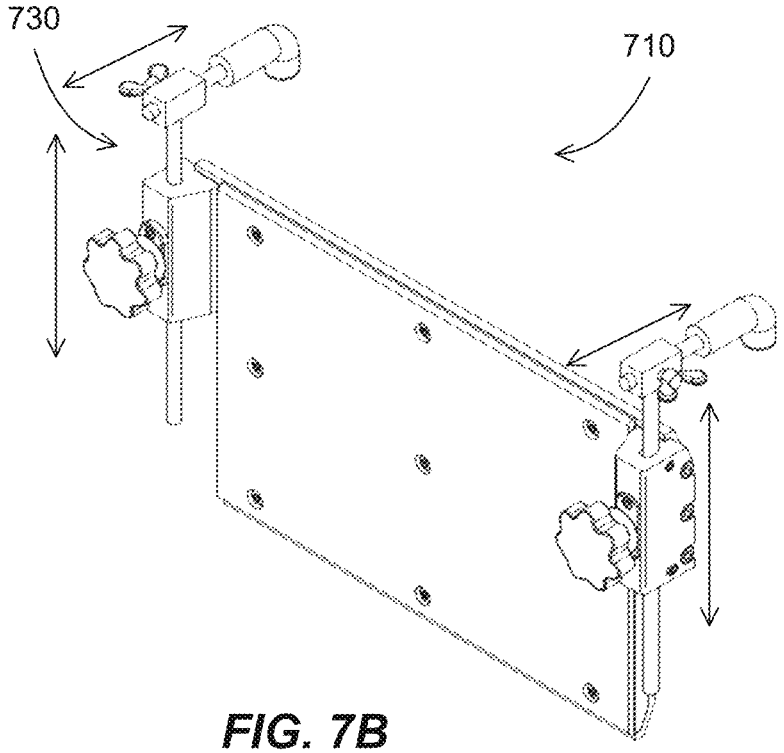

FIGS. 7A-7B illustrate a plate assembly according to some embodiments. The plate assembly 710 can include a xy mechanism 730 coupled to a plate 711 and a mounting feature 716. Additional plate 740 can be screwed on the plate 711 to increase the thickness of the plate 711. The xy mechanism can include a linear bearing or bushing 732 sliding along a rod 731 with a lock 733. The xy mechanism can include a linear bearing or bushing 735 sliding along a rod 734 with a lock 736. Antorotation feature can be used on the rod 735, with screws 738.

Figure 8:
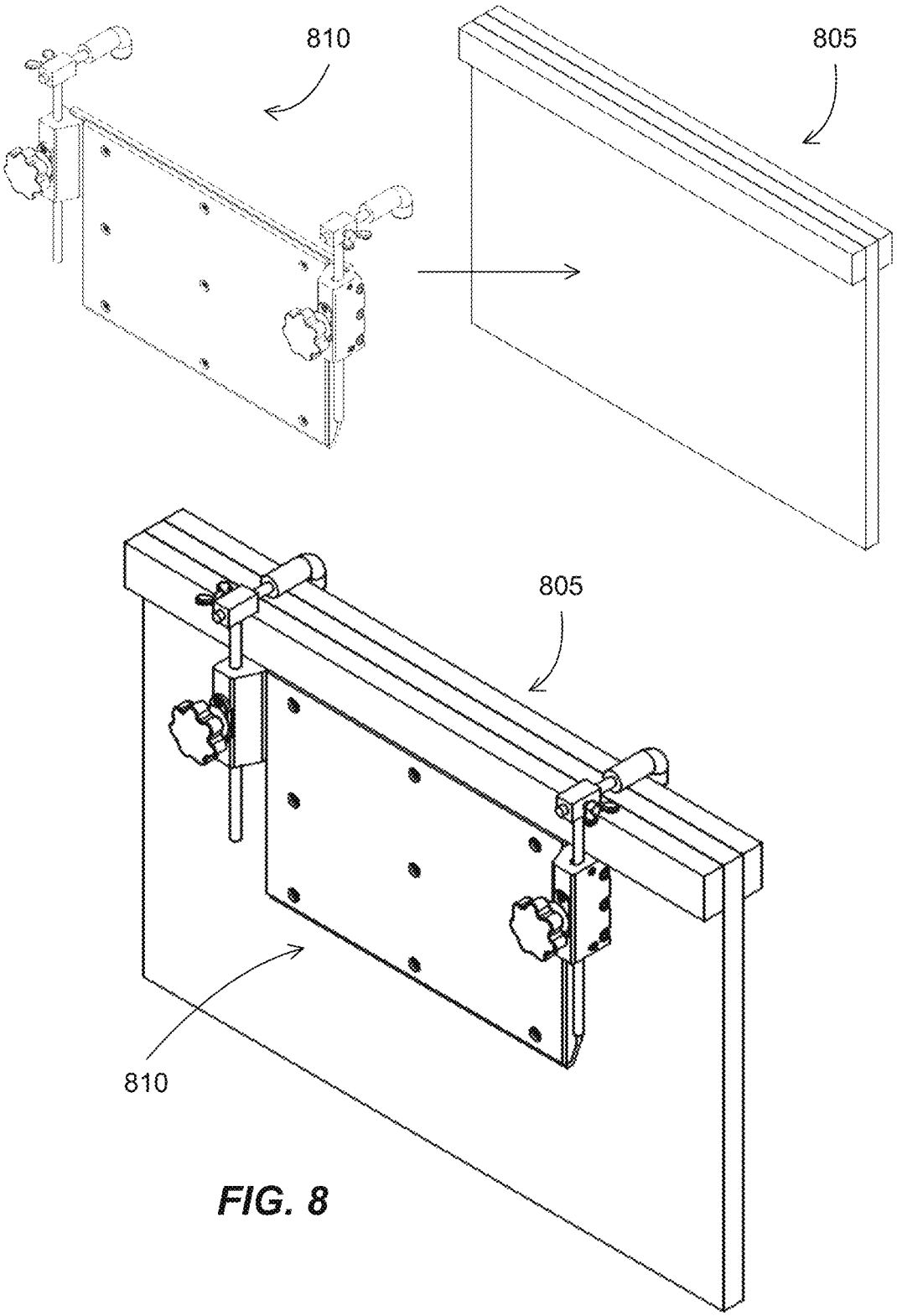
FIG. 8 illustrates a configuration for mounting a plate assembly on a non-flat panel according to some embodiments.

FIG. 8 illustrates a configuration for mounting a plate assembly on a non-flat panel according to some embodiments. A plate assembly 810 can be brought to a non-flat panel 805, such as a board having raised edge portions. The plate assembly then can be mounted on the non-flat panel, with the plate adjusted through the xy mechanism.

Figure 9A:
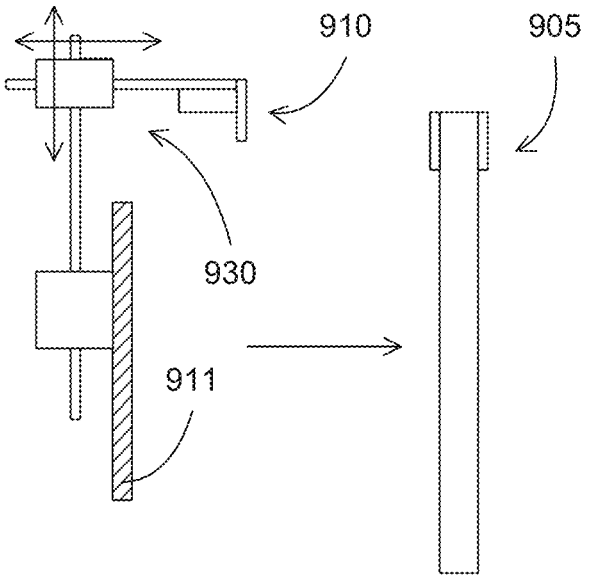
FIGS. 9A-9E illustrate a process for mounting a plate assembly on a panel according to some embodiments.
Figure 9B:
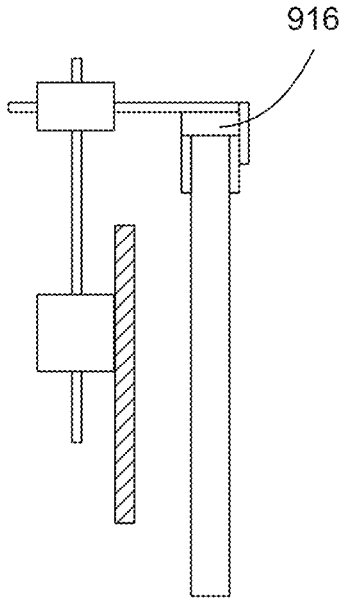
Figure 9C:
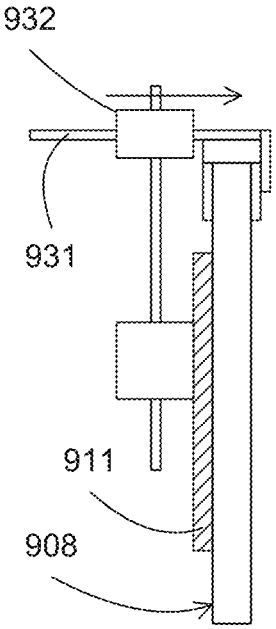
Figure 9D:
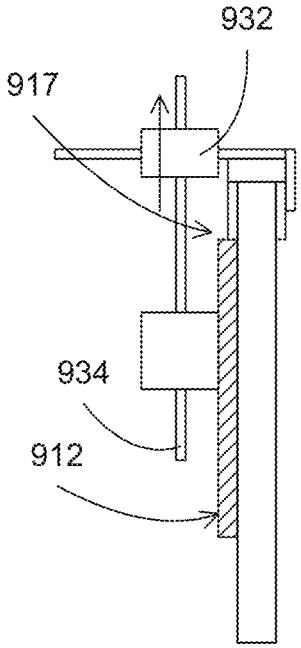
Figure 9E:
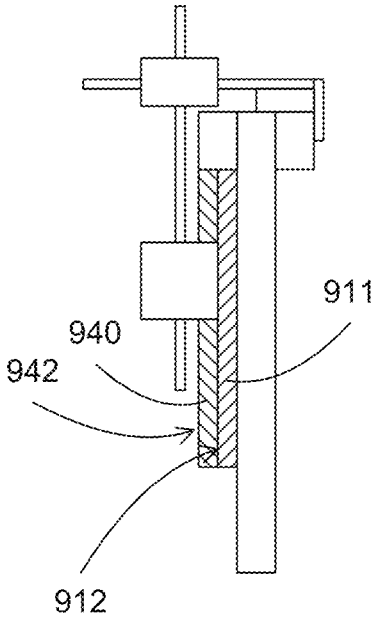

FIGS. 9A-9E illustrate a process for mounting a plate assembly on a panel according to some embodiments. In FIG. 9A, a plate assembly 910 having a plate 911 coupled to a xy mechanism 930 is brought to a panel 905, such as a panel having raised edge portions. In FIG. 9B, the plate assembly 910 is mounted on the panel 905 using a mounting feature 916. In FIG. 9C, the perpendicular movement can be performed, moving the plate 911 to contact the panel 905, for example, by sliding the linear bearing 932 along the perpendicular rod 951 until the plate 911 touches the surface 908 of the panel. In FIG. 9D, the parallel movement can be performed, moving the plate 911 to contact 917 the panel 905 at the raised edge portion, for example, by sliding the rod 954 through the linear bearing 932. The process can be complete if the thickness of the plate 911 is thicker than the thickness of the raised edge portion, e.g., the surface 912 of the plate is outside the raised edge portion so that the jaw of the clamping device can contact the plate surface 912. In FIG. 9E, if the thickness is less, another plate 940 can be mounted to the plate 911 to increase the thickness of the total plates. The external surface 942 of the additional plate 940 should be equal or outside the raised edge portion. Additional plate can be used, if the combined thickness of the two plates 911 and 940 is still less, until the thickness is equal or larger.

Figure 10A:
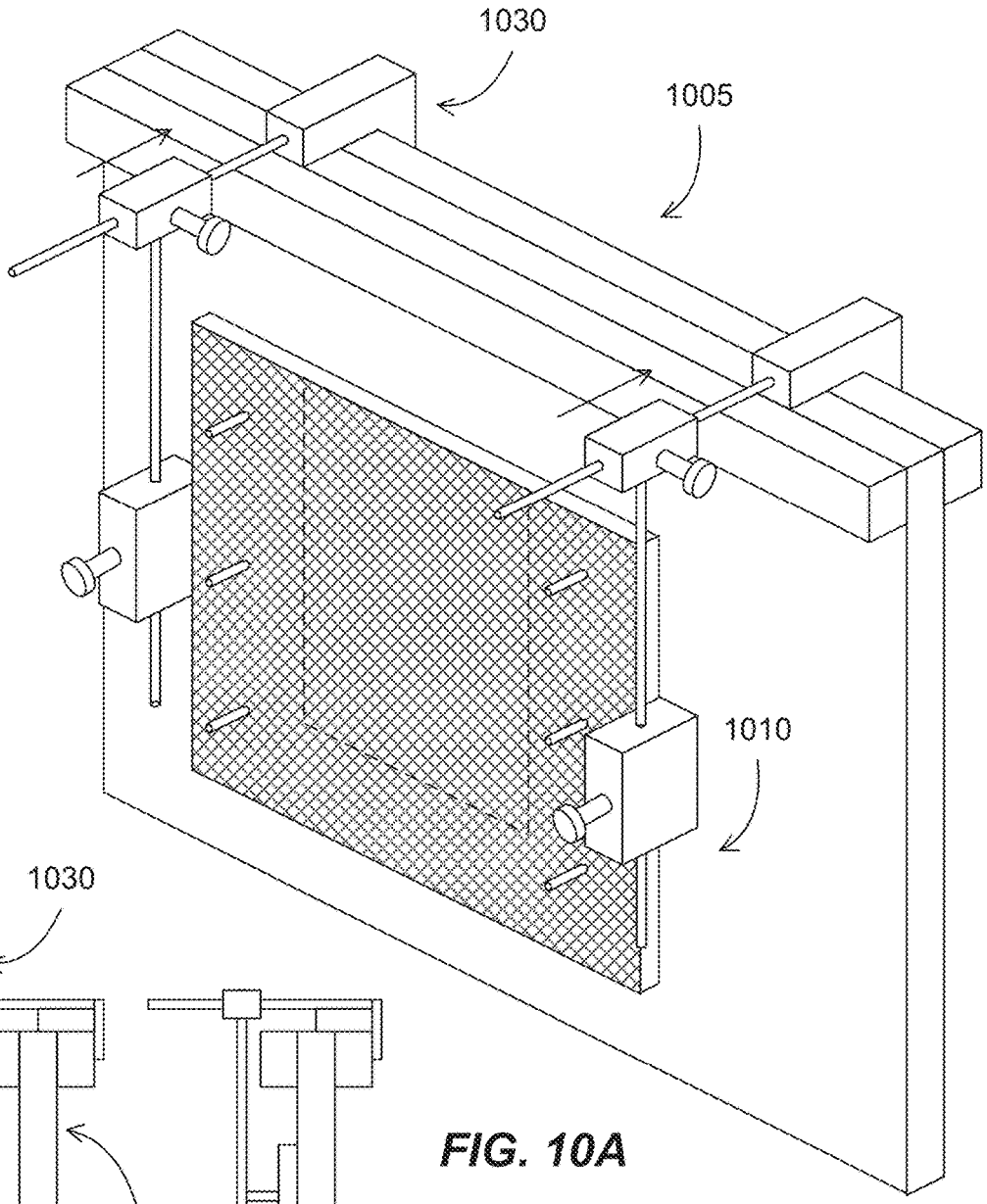
FIGS. 10A-10B illustrate a process for mounting a plate assembly on a panel according to some embodiments.
Figure 10B:
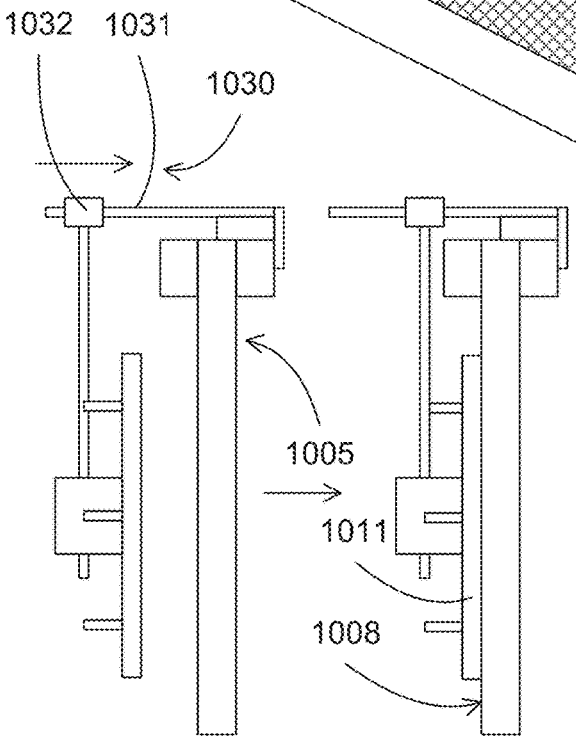

FIGS. 10A-10B illustrate a process for mounting a plate assembly on a panel according to some embodiments. FIG. 10A shows a perspective view and FIG. 10B shows a side view of a step of adjusting a plate 1011 of the plate assembly 1010 after the plate assembly is mounted on a panel 1005. A perpendicular linear bearing 1032 of a xy mechanism 1030 of the plate assembly 1010 can be slide along a rod 1031 until a back surface of the plate 1011 contacts a front surface of the panel 1005.

Figure 11A:
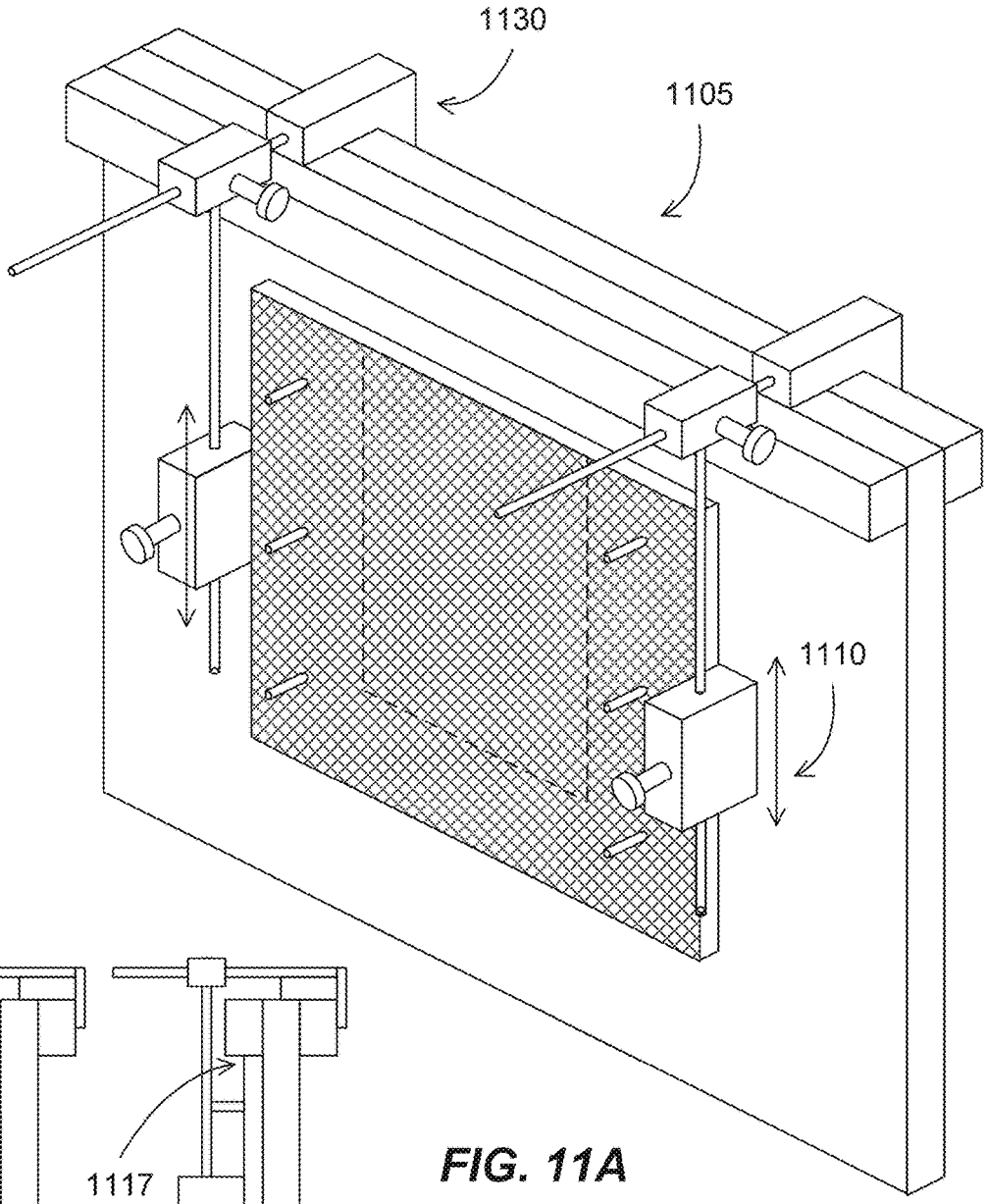
FIGS. 11A-11B illustrate a step of adjusting a plate assembly according to some embodiments.
Figure 11B:
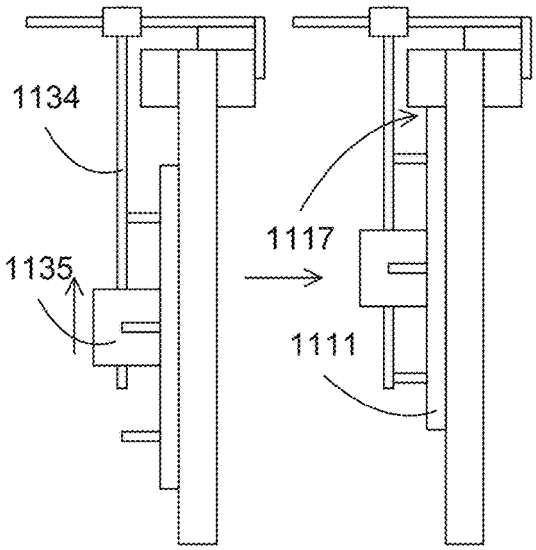

FIG. 11A shows a perspective view and FIG. 11B shows a side view of a step of adjusting a plate 1111 of the plate assembly 1110 after the plate assembly is adjusted so that the plate 1111 contact the surface of the panel 1105. A parallel linear bearing 1135 of a xy mechanism 1130 of the plate assembly 1110 can be slide along a rod 1134 until a top surface of the plate 1111 contacts 1107 a bottom surface of the edge of the panel 1105.

Figure 12:
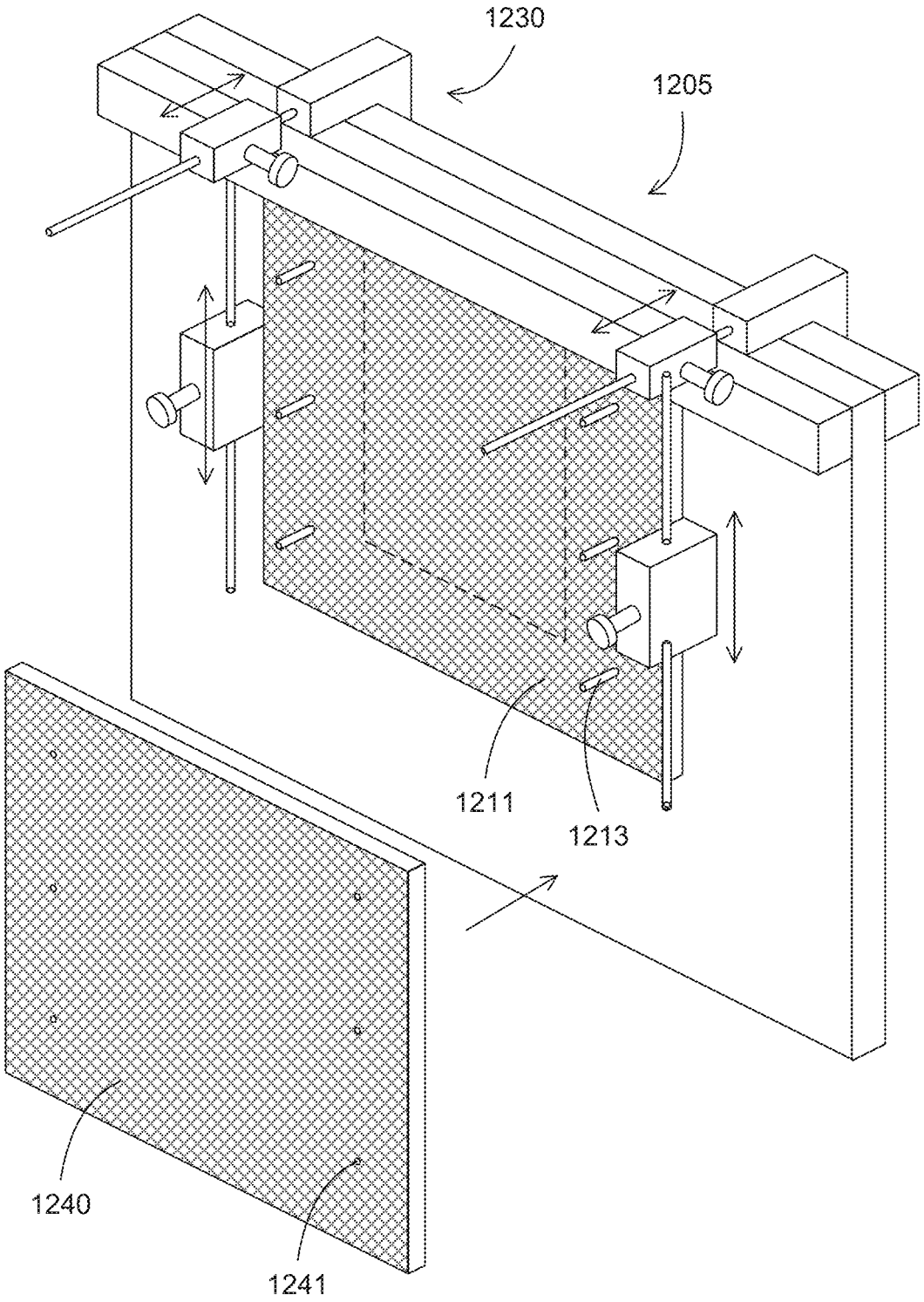
FIG. 12 illustrates an optional step of adjusting a thickness of the plate assembly according to some embodiments.

FIG. 12 shows a perspective view of an optional step of adjusting a thickness of the plate 1211 of the plate assembly 1210 after the plate assembly is adjusted so that the plate 1211 contact the front surface of the panel 1205 and the bottom surface of the edge of the panel 1205. Additional plate 1240 can be mounted on the plate 1211, for example, using holes 1241 mating with pins 1213, until a desired thickness of the plates is achieved.

Figure 13A:
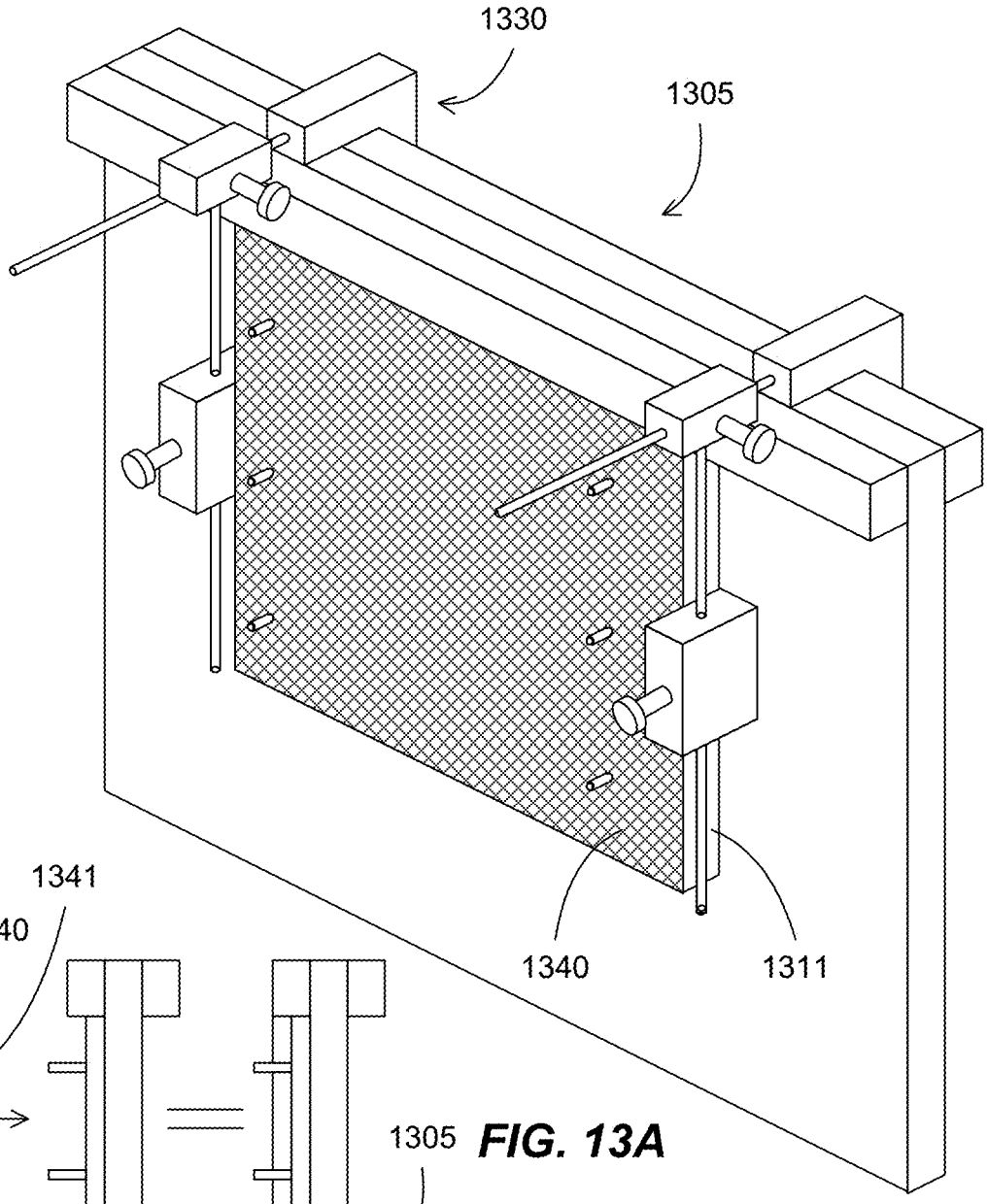
FIGS. 13A-13B illustrate an optional step of adjusting a thickness of the plate assembly according to some embodiments.
Figure 13B:
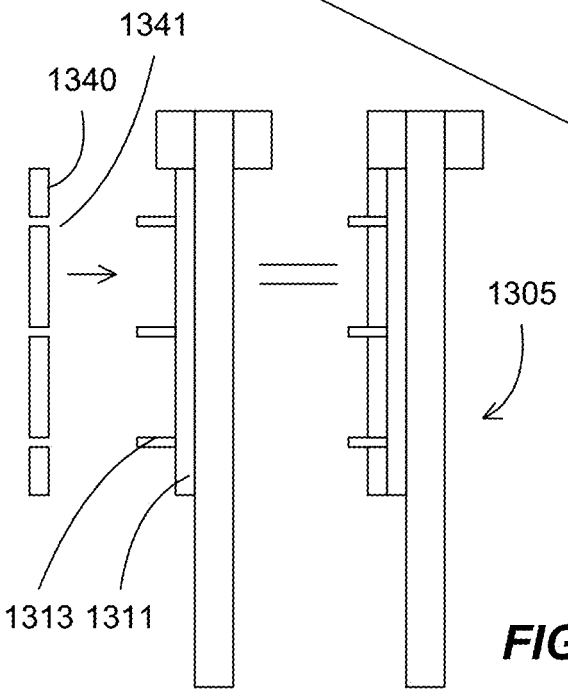

FIG. 13A shows a perspective view and FIG. 13B shows a side view of the optional step of adjusting a thickness of the plate 1311 of the plate assembly 1310 after the plate assembly is adjusted so that the plate 1311 contact the front surface of the panel 1305 and the bottom surface of the edge of the panel 1305. Additional plate 1340 can be mounted on the plate 1311, for example, using holes 1341 mating with pins 1313, until a desired thickness of the plates is achieved.

FIGS. 14A-14B illustrate flow charts for a plate assembly according to some embodiments. In FIG. 14A, operation 1400 forms a plate assembly. The plate assembly can include a plate coupled to a mounting feature through a moving mechanism. The mounting feature can be configured to be mounted on an object so that the plate is parallel to a surface of the object. The moving mechanism can be configured to move the plate in a direction parallel to the surface and in a direction perpendicular to the surface. The moving mechanism can include a rod sliding in a guide. The moving mechanism can include an antirotation feature. The plate can include a feature to increase the thickness of the plate. The thickness-increase feature can include multiple pins configured to mount another plate.

In FIG. 14B, operation 1420 mounts a plate assembly on an object. Operation 1430 adjusts the plate to contact surfaces of the object. Operation 1440 adds another plate to the plate assembly so that the total thickness is larger than the thickness of the object.

In some embodiments, the plate in the plate assembly, e.g., the plate 1411 attached to the xy mechanism or the additional plate 1440 to be attached to the plate 1411, can be made of a compressible material or a deformable material. The compressible material can include materials that can be compressed, e.g., to have a reduced volume or thickness. The compressible material can include a foam material or a porous polymer material. The deformable material can include materials that can be deformed, such as compressed in one area and expanding in another area. The deformable materials can include a rubber material or a polymer material. The compressible or deformable material can allow the clamping device to clamp on both the plate assembly, e.g., on the plate 1411 or 1440, and also on the raised edge portion of the panel 1405.

Figures 15A, 15B, 15C, 15D:
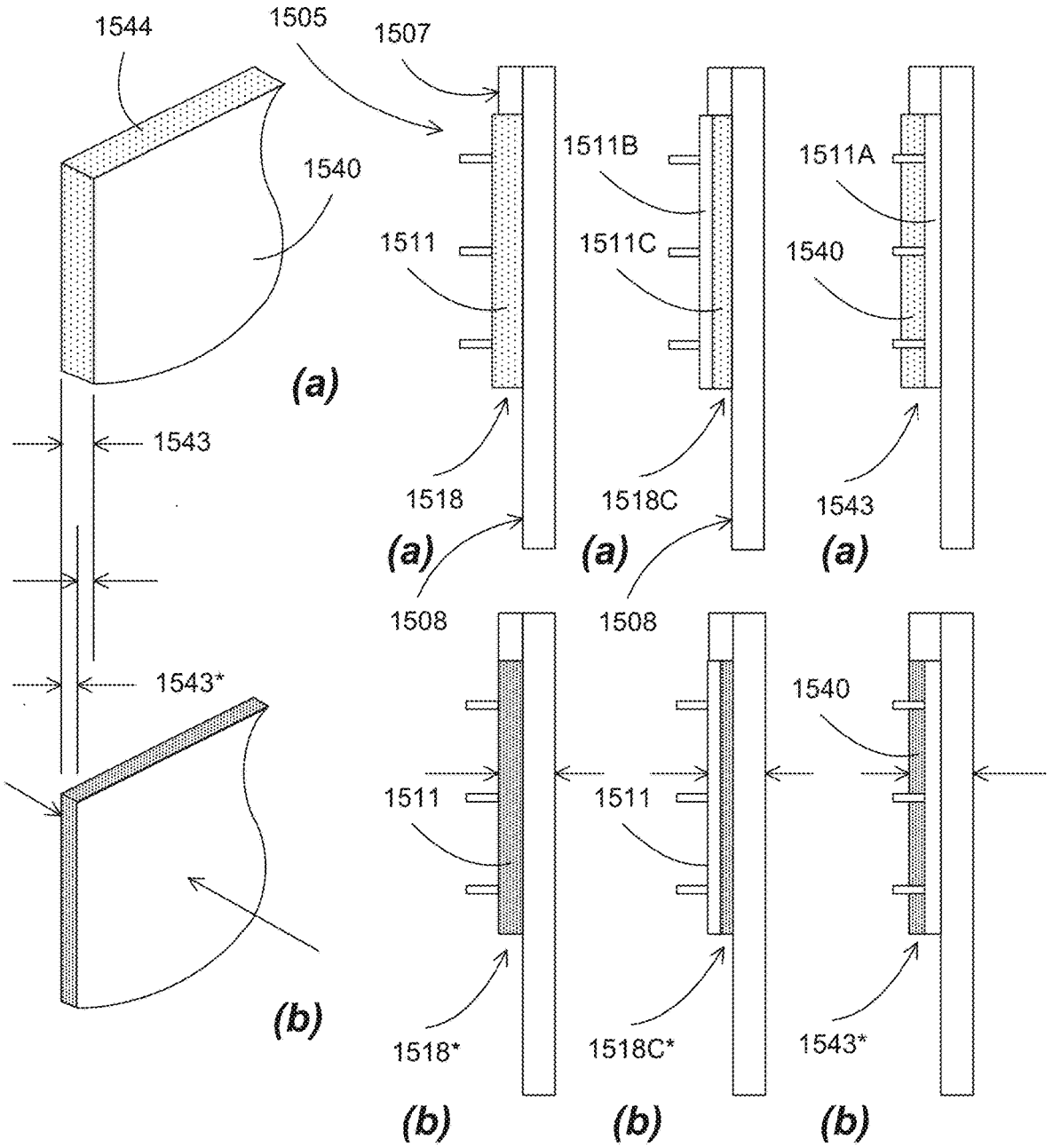
FIGS. 15A-15D illustrate configurations for compressible plate according to some embodiments.

FIGS. 15A-15D illustrate configurations for compressible plate according to some embodiments. In FIGS. 15A(*a*) and 15A(*b*), a plate, such as the additional plate 1540 to be mounted to the plate 1511 that is coupled to the xy mechanism of the plate assembly, can be formed of a compressible or deformable material 1544, e.g., the thickness 1543 of the plate 1540 can be compressed to be 1543*under a compressive force, such as the force applied by the jaws of a clamping device. The compressible or deformable material can be a compressible or deformable rubber material, a compressible or deformable polymer material, or a foam material. Other plates can also be made of a compressible or deformable material.

FIGS. 15B(*a*) and 15B(*b*) show a process for a compressible plate 1511 in a plate assembly. A plate assembly can have a plate 1511 formed of a compressible or deformable material. When mounted to a panel 1505, the plate 1511 can contact the recess surface 1508 of the panel 1505. The thickness 1618 of the plate 1511 can be higher than the height of the raised edge portion of the panel 1505, such as higher than the difference between the surface 1507 of the raised edge portion and the surface 1508 of the recess portion of the panel. Thus, after the plate assembly is mounted on the panel, the compressible plate 1511 protrudes from the surface of the panel, e.g., the surface of the plate 1511 is the tallest surface of the panel, above the raised edge surface 1507.

Thus, when the panel is clamped by a clamping device, a jaw of the clamping device can contact the surface of the compressible or deformable plate 1511. Under the compressed force of the jaws of the clamping device, the plate 1511 can be compressed to achieve a thickness 1518*that is leveled with the raised edge surface 1507, e.g., the raised edge portion can stop the plate from being further compressed. The jaw thus can clamp on both the plate and the raised edge portion.

The compressible or deformable material of the plate 1511 can be selected to be compressible for a larger distance than to be stopped at the raised edge surface, e.g., the minimum thickness of the plate 1511 can be smaller than is already compressed, and the plate is stopped being compressed due to the raised edge portion of the panel.

FIGS. 15C(*a*) and 15C(*b*) show a process for a composite plate having a compressible layer 1511C and a non-compressible layer 1511B in a plate assembly. A plate assembly can have a layer 1511C formed of a compressible or deformable material coupled to a non-compressible layer 1511B. When mounted to a panel 1505, the layer 1511B (not shown) or 1511C (shown in the figure) can contact the recess surface 1508 of the panel 1505. The combined thickness 1618C of the layers 1511B/1511C can be higher than the height of the raised edge portion of the panel 1505, such as higher than the difference between the surface 1507 of the raised edge portion and the surface 1508 of the recess portion of the panel. Thus, after the plate assembly is mounted on the panel, the composite plate 1511B/1511C protrudes from the surface of the panel, e.g., the surface of the plate 1511B/1511C is the tallest surface of the panel, above the raised edge surface 1507.

Thus, when the panel is clamped by a clamping device, a jaw of the clamping device can contact the surface of the outer layer of the composite plate 1511B/1511C. Under the compressed force of the jaws of the clamping device, the compressible layer 1511C in the composite plate 1511B/1511C can be compressed to achieve a total thickness 1518C*that is leveled with the raised edge surface 1507, e.g., the raised edge portion can stop the plate from being further compressed. The jaw thus can clamp on both the plate and the raised edge portion.

FIGS. 15D(*a*) and 15D(*b*) show a process for a compressible plate 1540 coupled to a plate 1511A in a plate assembly. A plate assembly can have a plate 1511A, which can be formed of a compressible material or a rigid material. When mounted to a panel 1505, the plate 1511 can contact the recess surface of the panel 1505. The thickness of the plate 1511 can be less than the height of the raised edge portion of the panel 1505, such as less than the difference between the surface of the raised edge portion and the surface of the recess portion of the panel. One or more compressible additional plates 1540 can be mounted on the plate 1511 to increase the thickness, e.g., the combined thickness of the plates is increased. For example, the thickness of the additional plate 1540 can be 1543, which can be added to the thickness of the plate 1511, to be higher than the raised edge portion of the panel.

Thus, after the additional plate is mounted on the plate assembly, the compressible plate 1540 protrudes from the surface of the panel, e.g., the surface of the plate 1540 is the tallest surface of the panel, above the raised edge surface 1507.

When the panel is clamped by a clamping device, a jaw of the clamping device can contact the surface of the compressible plate 1540. Under the compressed force of the jaws of the clamping device, the plate 1540 can be compressed to achieve a thickness 1543*that is leveled with the raised edge surface 1507, e.g., the raised edge portion can stop the plate from being further compressed. The jaw thus can clamp on both the plate and the raised edge portion.

FIGS. 16A-16D illustrate flow charts for compressible plate according to some embodiments. In FIG. 16A, operation 1600 forms a plate assembly, with the plate assembly having a plate coupled to a mounting feature through a moving mechanism. The plate can include a compressible material.

In FIG. 16B, operation 1620 forms a plate assembly, with the plate assembly having a plate coupled to a mounting feature through a moving mechanism. The plate can include a feature to increase the thickness of the plate by mounting a second plate next to the plate. The second plate can include a compressible material.

In FIG. 16C, operation 1640 mounts a plate assembly on an object, with the plate of the plate assembly having a compressible material. The thickness of the plate can be larger than that of an object, wherein the maximum compressed amount of the plate can be larger than a difference between the plate thickness and a thickest portion of the object.

In FIG. 16D, operation 1660 mounts a plate on a plate assembly, with the plate comprises a compressible material. The total thickness of the plate and the plate assembly can be larger than that of an object. The maximum compressed amount of the plate can be larger than a difference between the total thickness and a thickest portion of the object In some embodiments, the xy mechanism in a plate assembly can be just a linear guide in one direction, such as in a direction parallel to the panel surface. The movements in the parallel direction can accommodate different widths of the raised edge portion, since the plate can move along the parallel direction to contact, or to be closest possible, to the raised edge portion. The movements along the perpendicular direction can be performed by moving the whole plate assembly toward the panel, instead of just moving the plate.

Figures 17A, 17B:
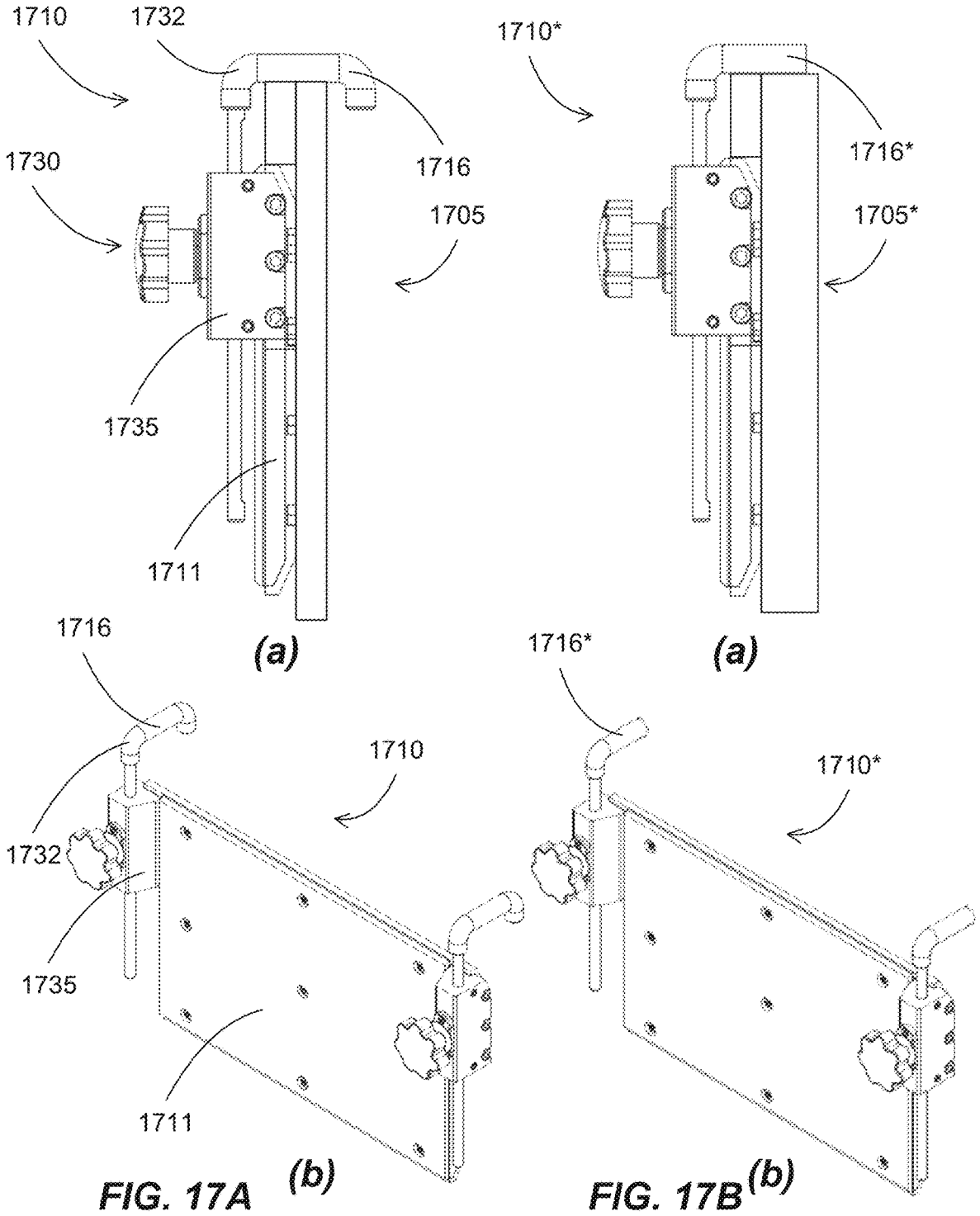
FIGS. 17A-17B illustrate configurations for plate assemblies according to some embodiments.

FIGS. 17A-17B illustrate configurations for plate assemblies according to some embodiments. FIG. 17A(*a*) shows a side view and FIG. 17A(*b*) shows a perspective view of a plate assembly 1710, having a parallel moving mechanism 1730 that is coupled to a plate 1711 through a linear bearing 1735. The parallel moving mechanism 1730 is configured to move the plate 1711 in a direction parallel to the panel 1705. A mounting feature 1716 is coupled to the parallel moving mechanism 1730, for mounting the parallel mechanism to the panel 1705. The mounting feature 1716 is configured to allow the parallel moving mechanism 1730 to move in a perpendicular direction, which can allow the plate to move to be in contact with the panel.

FIG. 17B(*a*) shows a side view and FIG. 17B(*b*) shows a perspective view of another plate assembly 1710*, having a similar parallel moving mechanism. A different mounting feature 1716*is coupled to the parallel moving mechanism, for mounting the parallel mechanism to the panel 1705*. The mounting feature 1716*is configured to allow the parallel moving mechanism 1730 to move in a perpendicular direction, which can allow the plate to move to be in contact with the panel.

In some embodiments, two plate assemblies can be mounted to two sides of a panel, to provide clamping surfaces for the panel having raised edge portions on both sides.

Figure 18A:
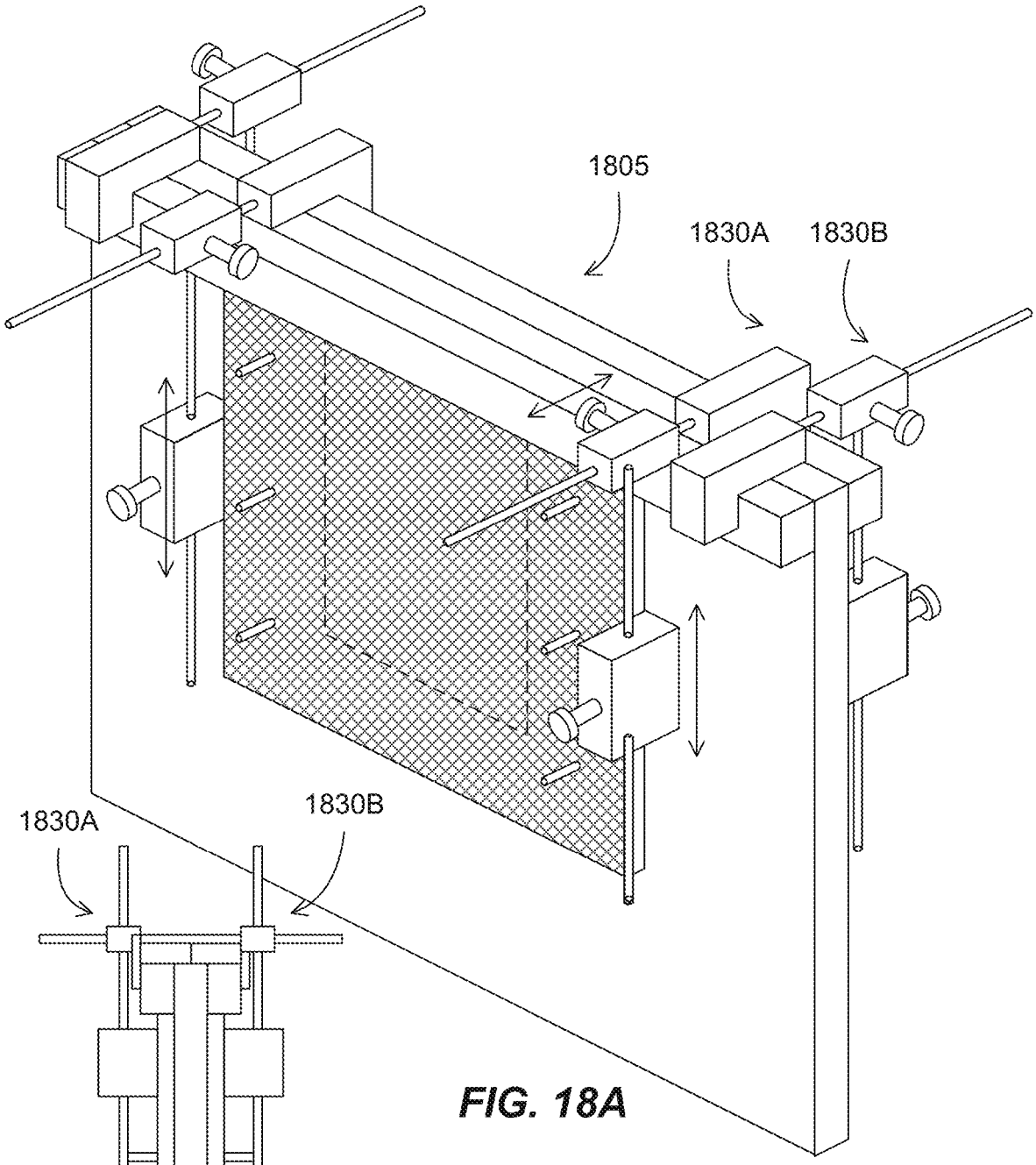
FIGS. 18A-18B illustrate a configuration for mounting two plate assemblies on two sides of a panel according to some embodiments.
Figure 18B:
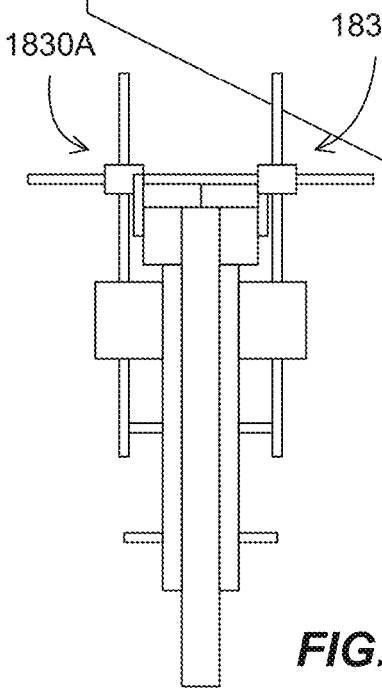

FIGS. 18A-18B illustrate a configuration for mounting two plate assemblies on two sides of a panel according to some embodiments. FIG. 18A shows a perspective view and FIG. 18B shows a side view of the plate assemblies 1810A and 1810B mounted on a panel 1805. As shown, the mounting features of the plate assembly 1810A are disposed inside the mounting features of the plate assembly 1810B. Other configurations can be used, such as the mounting features of the plate assembly 1810A is disposed outside the mounting features of the plate assembly 1810B, or the mounting features of the plate assembly 1810A is interlaced with the mounting features of the plate assembly 1810B.

In some embodiments, a plate assembly can be mounted on a panel of a stack of panels, to allow a clamping device to lift and move the panel to a new location.

Figure 19A:
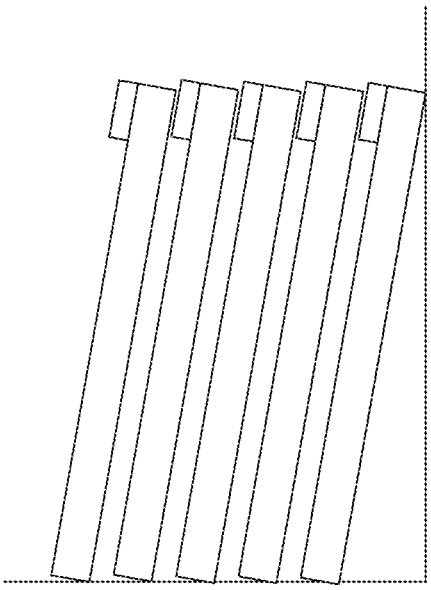
FIGS. 19A-19D illustrate a process for moving a panel according to some embodiments.
Figure 19B:
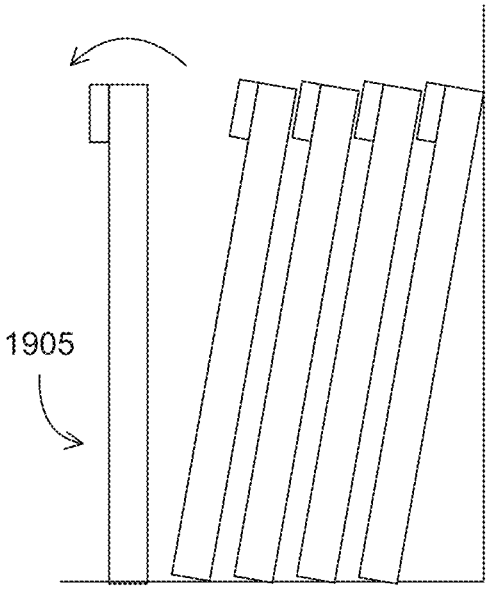
Figure 19C:
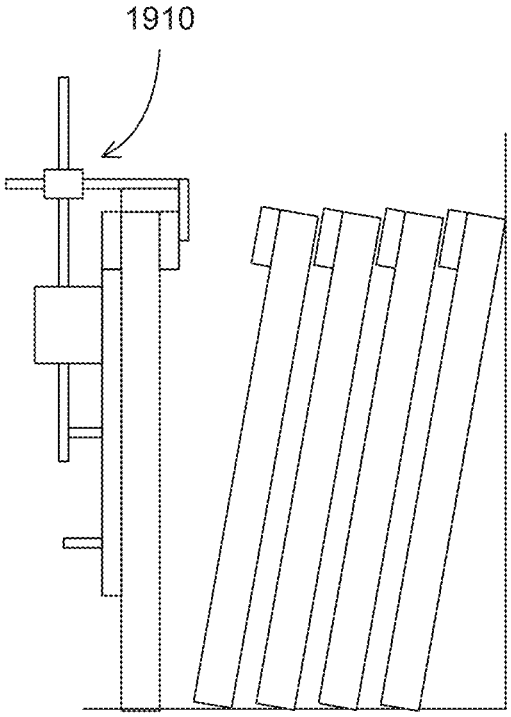
Figure 19D:
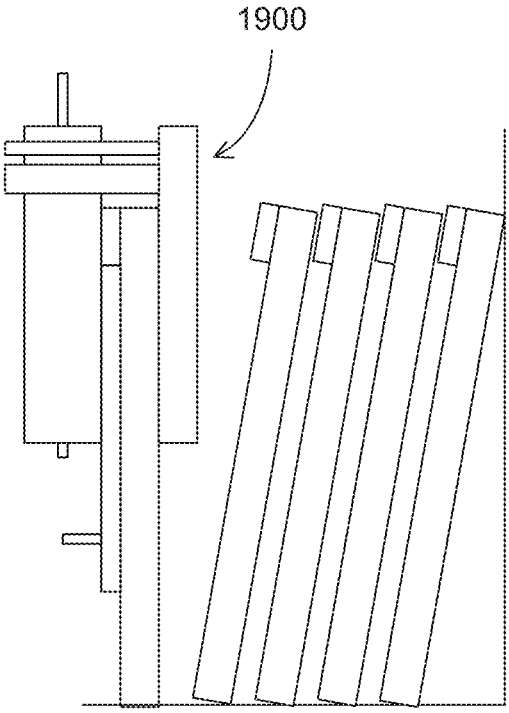

FIGS. 19A-19D illustrate a process for moving a panel according to some embodiments. In FIG. 19A, a stack of panels can be placed against a wall. The panels can have a raised edge portion to one side. In FIG. 19B, the outermost panel 1905 can be rotated out, e.g., rotated relative to the ground to expose the top portion. In FIG. 19C, a plate assembly 1910 can be mounted on the panel 1905, and the plate of the plate assembly can be adjusted so that the plate contacts panel surfaces, e.g., the lateral surface of the recess portion and the vertical surface with the raised edge portion. In FIG. 19D, a clamping device can be lowered on the panel having the mounted plate assembly for clamping on the plate.

Figure 20A:
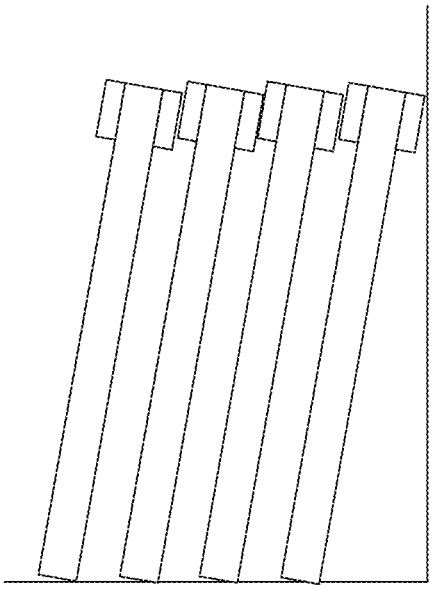
FIGS. 20A-20D illustrate a process for moving a panel according to some embodiments.
Figure 20B:
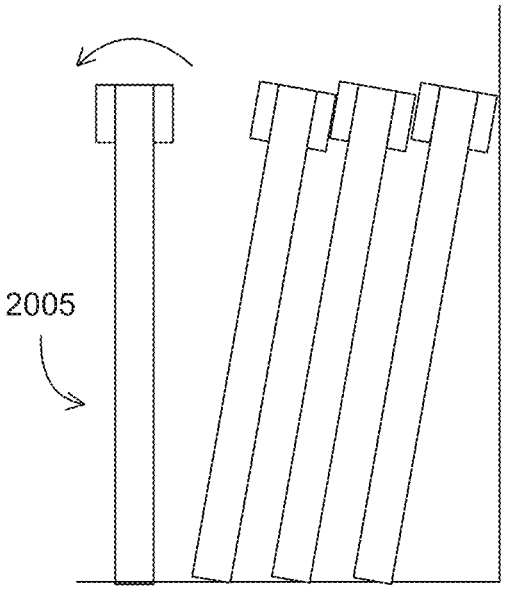
Figure 20C:
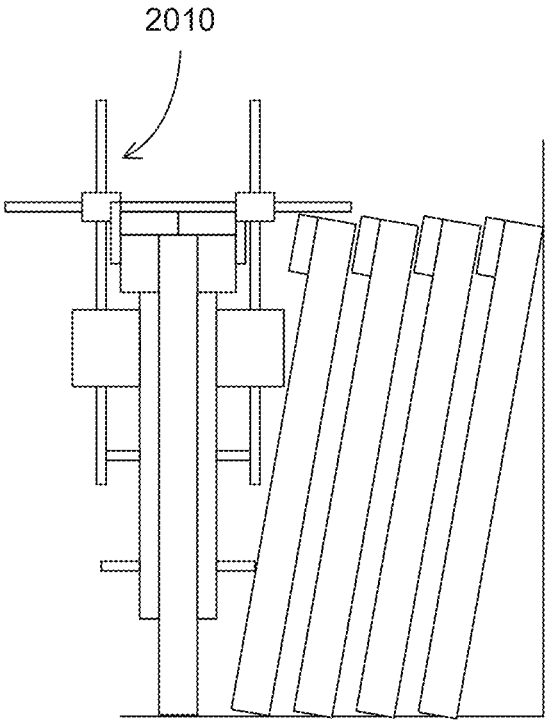
Figure 20D:
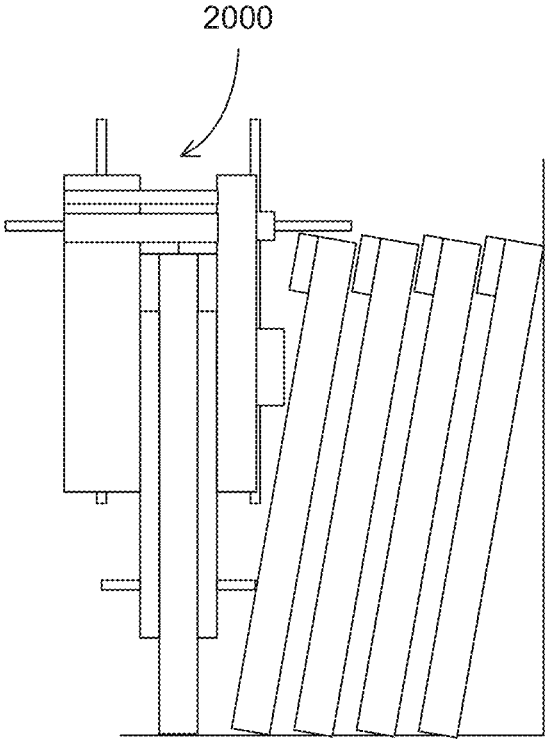

FIGS. 20A-20D illustrate a process for moving a panel according to some embodiments. In FIG. 20A, a stack of panels can be placed against a wall. The panels can have raised edge portions in both sides of the panels. In FIG. 20B, the outermost panel 2005 can be rotated out, e.g., rotated relative to the ground to expose the top portion. In FIG. 20C, a plate assembly 2010 can be mounted on the panel 2005, and the plate of the plate assembly can be adjusted so that the plate contacts panel surfaces, e.g., the lateral surface of the recess portion and the vertical surface with the raised edge portion. In FIG. 20D, a clamping device can be lowered on the panel having the mounted plate assembly for clamping on the plate.

Figure 21A:
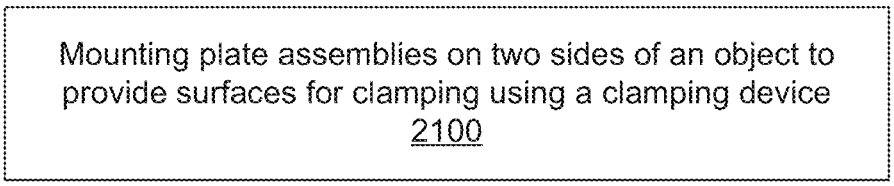
FIGS. 21A-21B illustrate flow charts for mounting plate assemblies on a panel according to some embodiments.
Figure 21B:
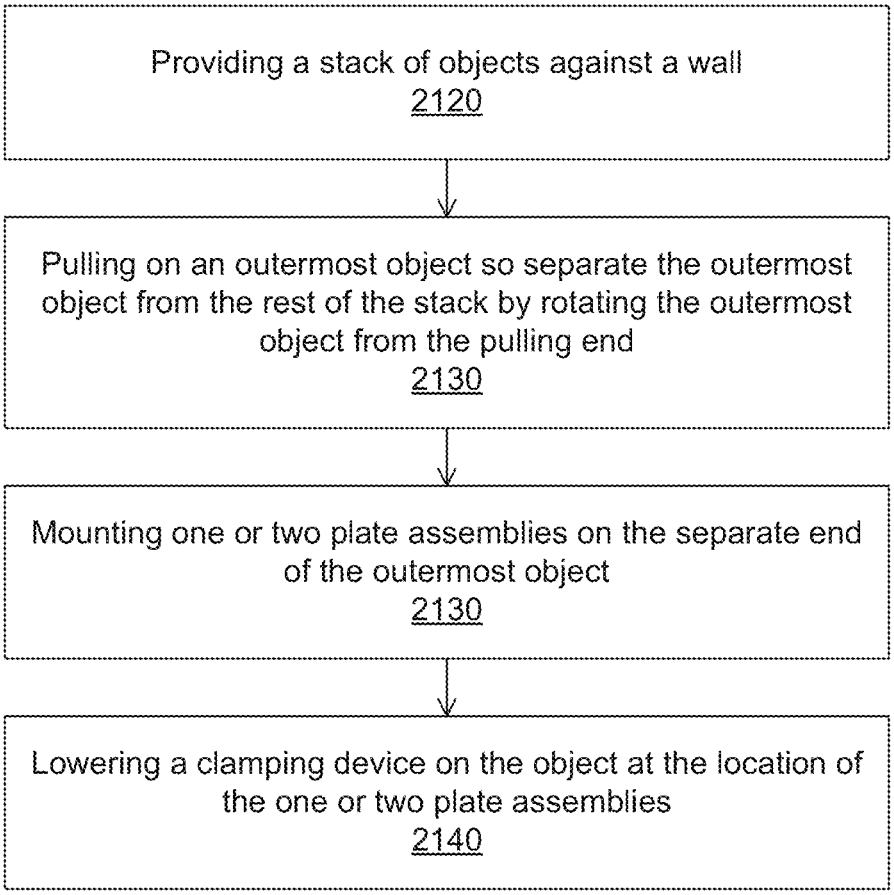

FIGS. 21A-21B illustrate flow charts for mounting plate assemblies on a panel according to some embodiments. In FIG. 21A, operation 2100 mounts plate assemblies on two sides of an object to provide surfaces for clamping using a clamping device.

In FIG. 21B, operation 2120 provides a stack of objects against a wall. Operation 2130 pulls on an outermost object so separate the outermost object from the rest of the stack by rotating the outermost object from the pulling end. Operation 2130 mounts one or two plate assemblies on the separate end of the outermost object. Operation 2130 lowers a clamping device on the object at the location of the one or two plate assemblies.

In some embodiments, the present invention discloses an add-on plate assembly for a clamping device to handle irregular object, such as a non-flat panel or a panel with non-parallel surfaces of with non-flat surfaces. The add-on plate assembly can be mounted to one or two jaw of the clamping device, so that the object can be clamped and lifted using the clamping device.

The add-on plate assembly can include a plate to provide a raised surface on the jaw for the clamping device to clamp on. For example, for objects having a large recessed surface area, the jaw with the plate can be applied to the recessed area to increase the contact area of the clamping device with the object.

The plate can have a mounting feature for another plate, e.g., for another plate to be attached to the plate to increase the thickness of the plate. Since the thickness of the plate should be higher than the deepest recess of the object, additional plates can be mounted to the plate of the plate assembly to provide an adequate thickness for the plate assembly.

The plate assembly can include a mounting feature for mounting on the jaw, such as to mount on two sides of the jaw. The mounting feature can include one or two side portions having secure feature such as nuts and bolts to secure on the sides of the jaw.

Figure 22A:
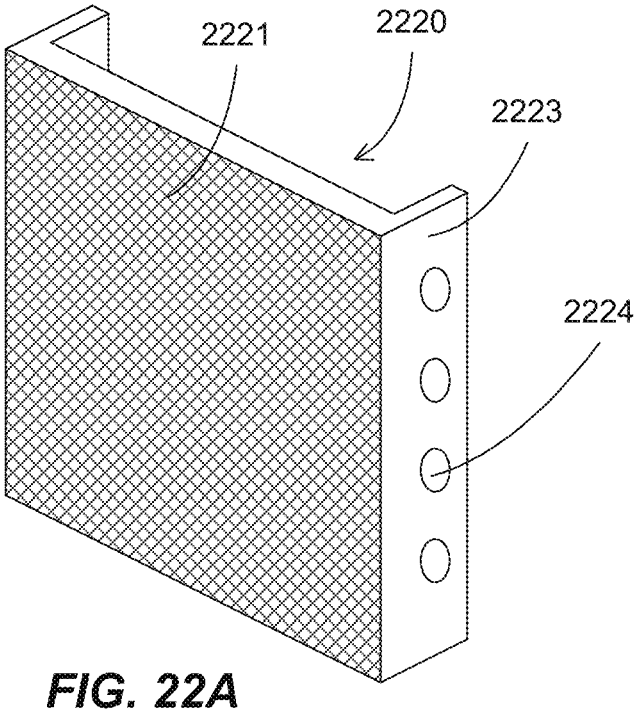
FIGS. 22A-22B illustrate a plate assembly for mounting on a jaw according to some embodiments.
Figure 22B:
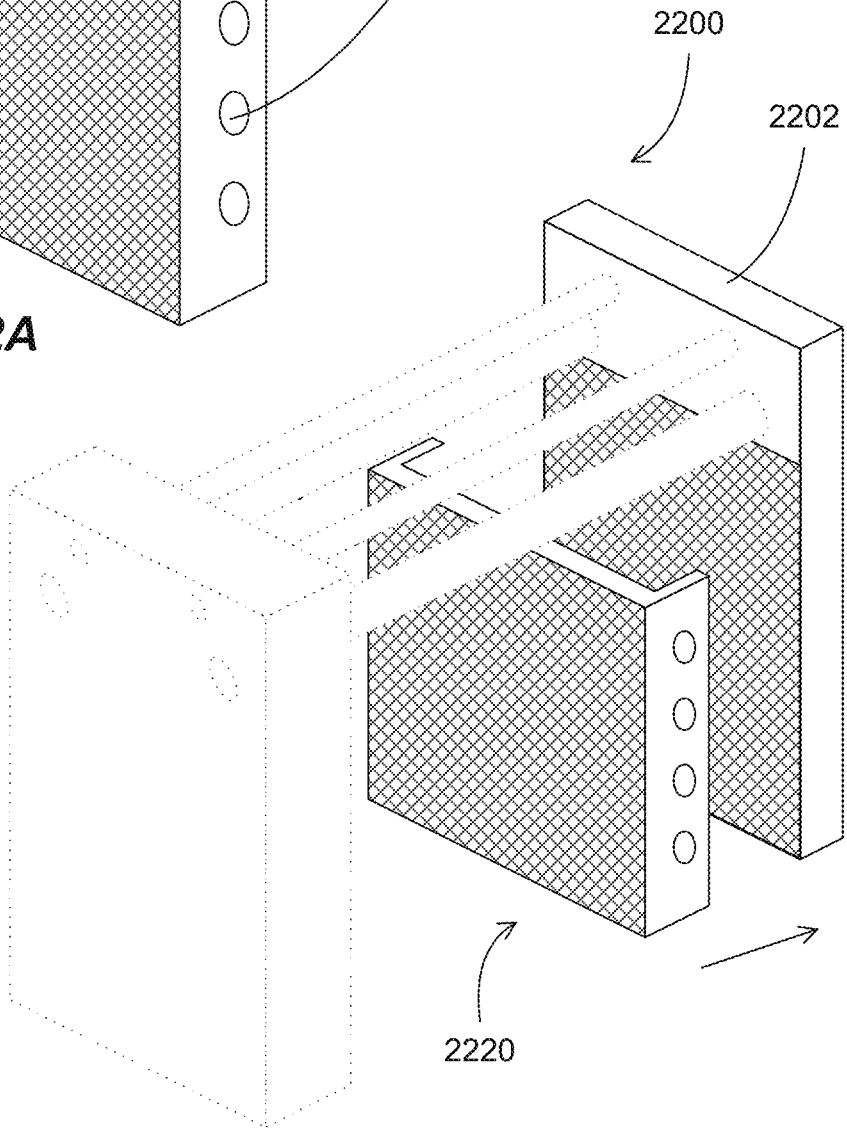

FIGS. 22A-22B illustrate a plate assembly for mounting on a jaw according to some embodiments. In FIG. 22A, a plate assembly 2220 can include a plate 2221 and two side portions 2223. There can be secure features on the side portions 2223, such as coupled nuts 2224 to attaching bolts. In FIG. 22B, a plate assembly 2220 can be mounted on a jaw 2202 of a clamping device 2200. Bolts can be used in the secure feature to secure the plate assembly to the jaw.

Figure 23A:
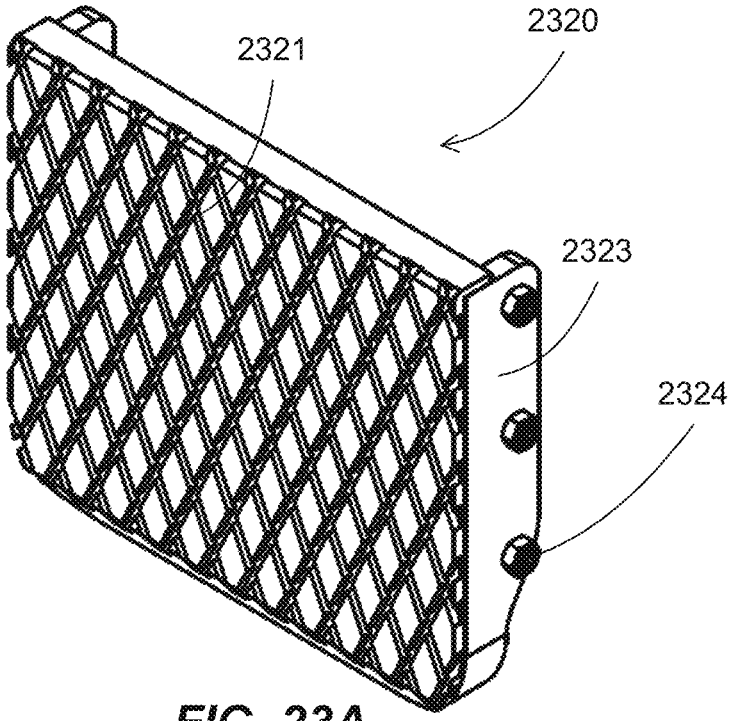
FIGS. 23A-23B illustrate perspective views of a plate assembly according to some embodiments.
Figure 23B:
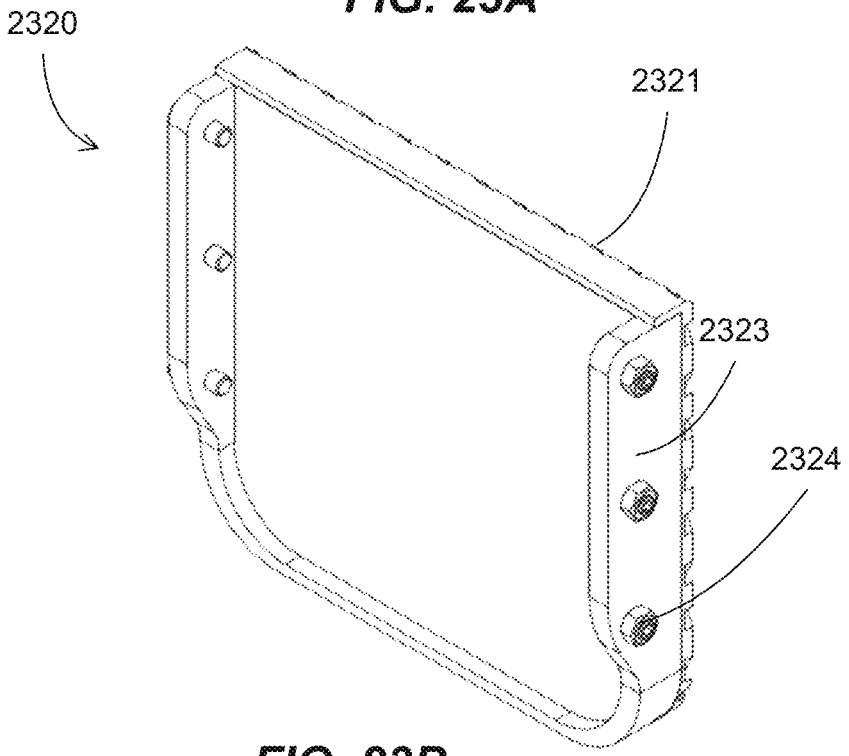

FIGS. 23A-23B illustrate perspective views of a plate assembly according to some embodiments. FIG. 23A shows a front side perspective view, and FIG. 23B shows a back-side perspective view of a plate assembly 2320. The plate assembly 2320 is configured to be attached to a jaw of a clamping device. The plate assembly 2320 can include a plate 2311 and two side portions 2323. Nuts 2324 can be included in the side portions 2323 for securing the plate assembly to the jaw.

Figure 24:
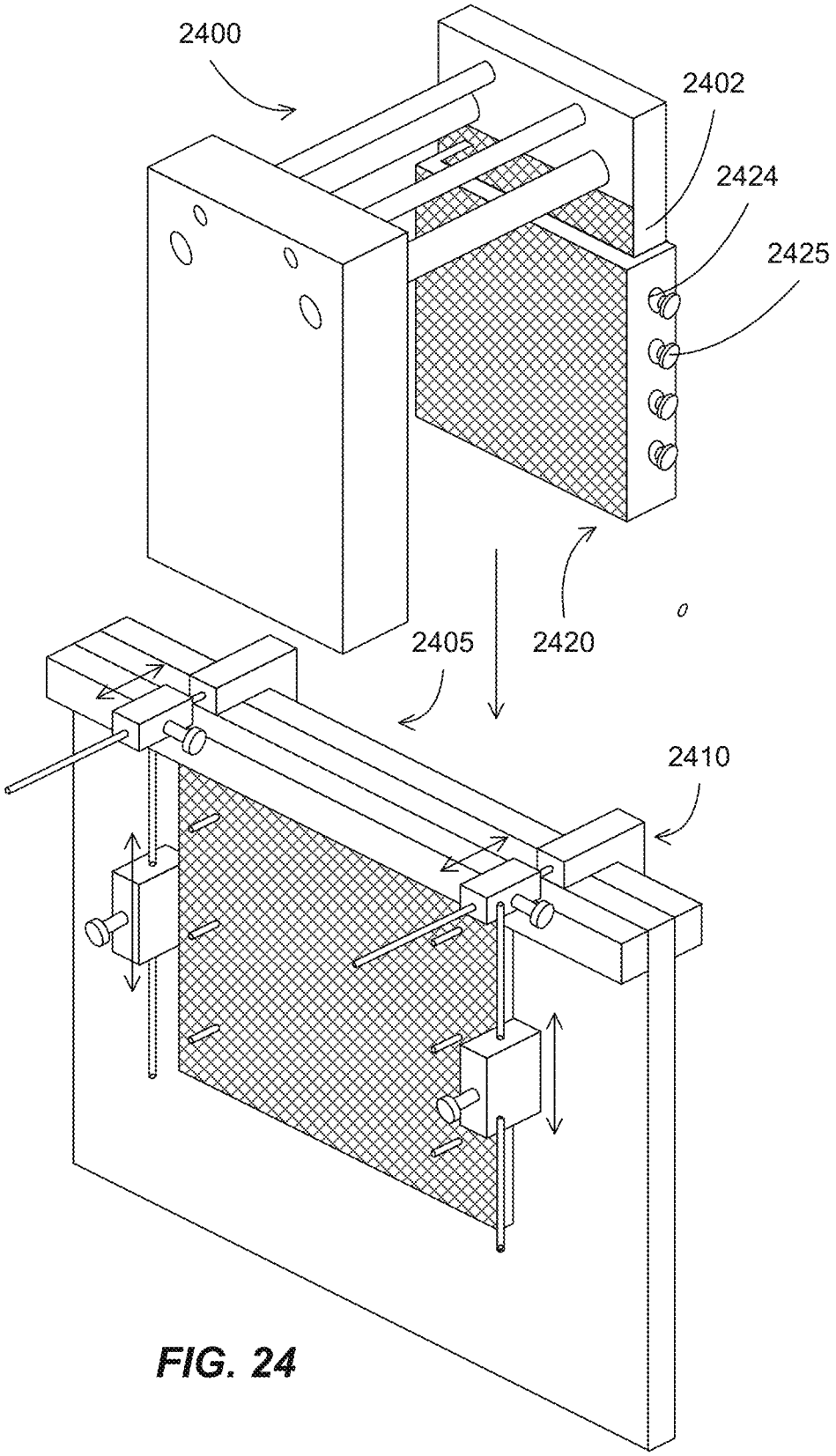
FIG. 24 illustrates a process for mounting a clamping device on a panel according to some embodiments.

FIG. 24 illustrates a process for mounting a clamping device on a panel according to some embodiments. The panel 2405 can have raised edge portions at both front and back sides of the panel. On the front side, a plate assembly 2410 for the object can be mounted to the panel. A plate assembly 2420 for the clamping device 2400 can be mounted on the jaw 2402 to compensate for the raised edge portion at the back side of the panel. Bolts 2425 can be used to secure the plate assembly 2420 to the jaw 2402, through the nuts 2424.

Thus, the clamping device 2400 can contact the plate of the object plate assembly 2410 at the front side of the panel. At the back side, the plate of the jaw plate assembly 2420 at the jaw can contact the back side of the panel.

Figure 25:
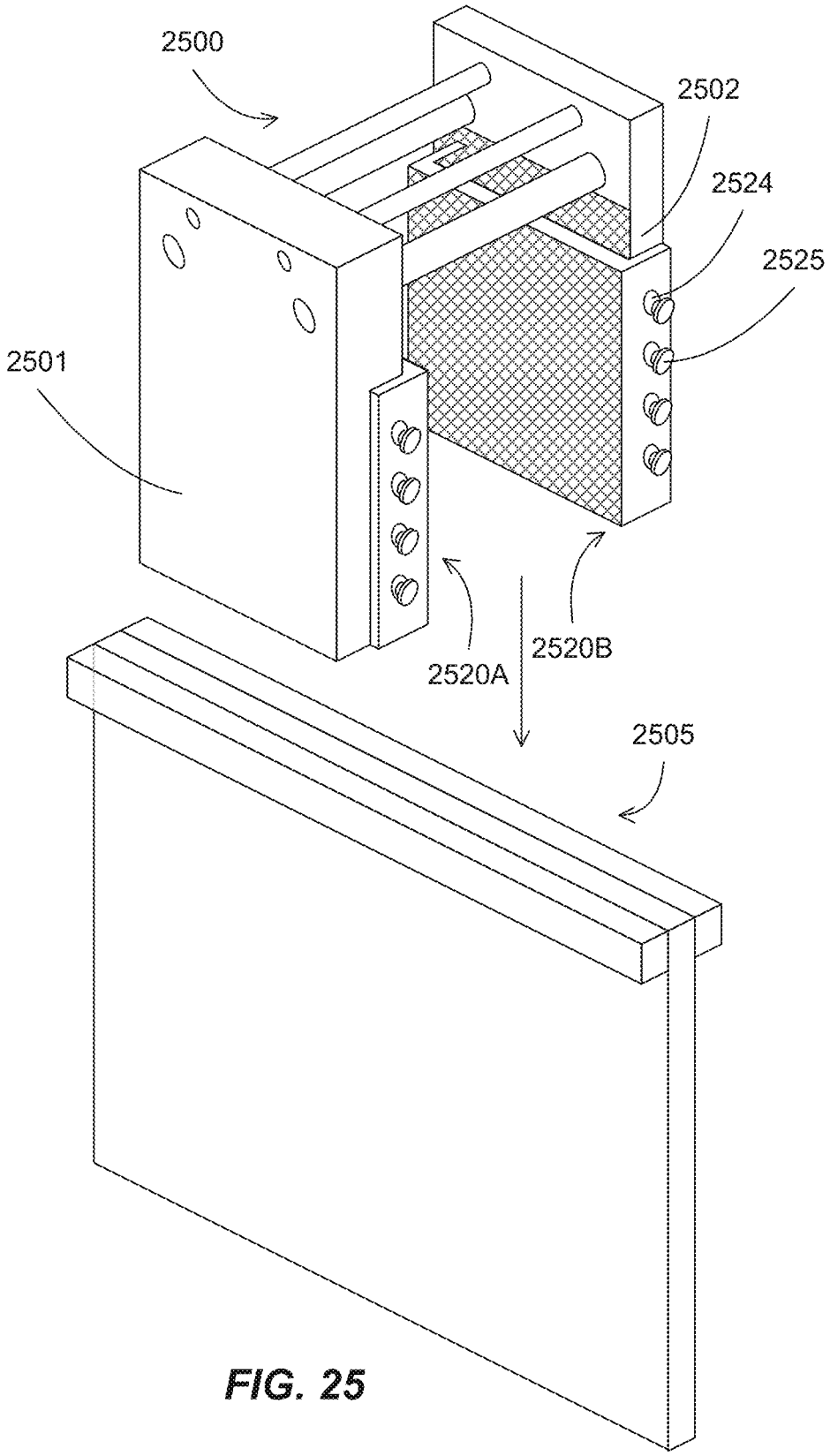
FIG. 25 illustrates a process for mounting a clamping device on a panel according to some embodiments.

FIG. 25 illustrates a process for mounting a clamping device on a panel according to some embodiments. The panel 2505 can have raised edge portions at both front and back sides of the panel. A plate assembly 2520A for the clamping device 2500 can be mounted on the jaw 2501 to compensate for the raised edge portion at the front side of the panel. Bolts can be used to secure the plate assembly 2520A to the jaw 2501, through the nuts. A second plate assembly 2520B for the clamping device 2500 can be mounted on the jaw 2502 to compensate for the raised edge portion at the back side of the panel. Bolts 2525 can be used to secure the plate assembly 2520B to the jaw 2502, through the nuts 2524.

Thus, at the front side, the plate of the jaw plate assembly 2520A at the jaw 2501 can contact the front side of the panel. At the back side, the plate of the jaw plate assembly 2520B at the jaw 2502 can contact the back side of the panel.

FIGS. 26A-26C illustrate flow charts for plate assemblies at jaws of a clamping device according to some embodiments. In FIG. 26A, operation 2600 forms a plate assembly. The plate assembly can include a plate coupled to a mounting feature. The mounting feature can be configured to be mounted on a jaw of a clamping device configured to clamp on an object. The mounting feature can be configured to be coupled to sides of the jaw.

In FIG. 26B, operation 2620 mounts one or two plate assembles on one or two jaws of a clamping device for clamping on an object. For example, one plate assembly can be mounted on one jaw, or two plate assemblies can each be mounted on a separate jaw.

In FIG. 26C, operation 2640 mounts a first plate assembly on an object. Operation 2650 mounts a second plate assembly on a jaw of a clamping device for clamping on an object. Operation 2660 lowers the clamping device on the object for clamping.

In some embodiments, the plate assembly for coupling to a jaw of a clamping device can be configured to be secured to the jaw. The secure feature can be on one side or on two sides of the plate assembly. The secure feature can include rods pushing through the side of the plate assembly to contact the jaw side surface.

Figure 27:
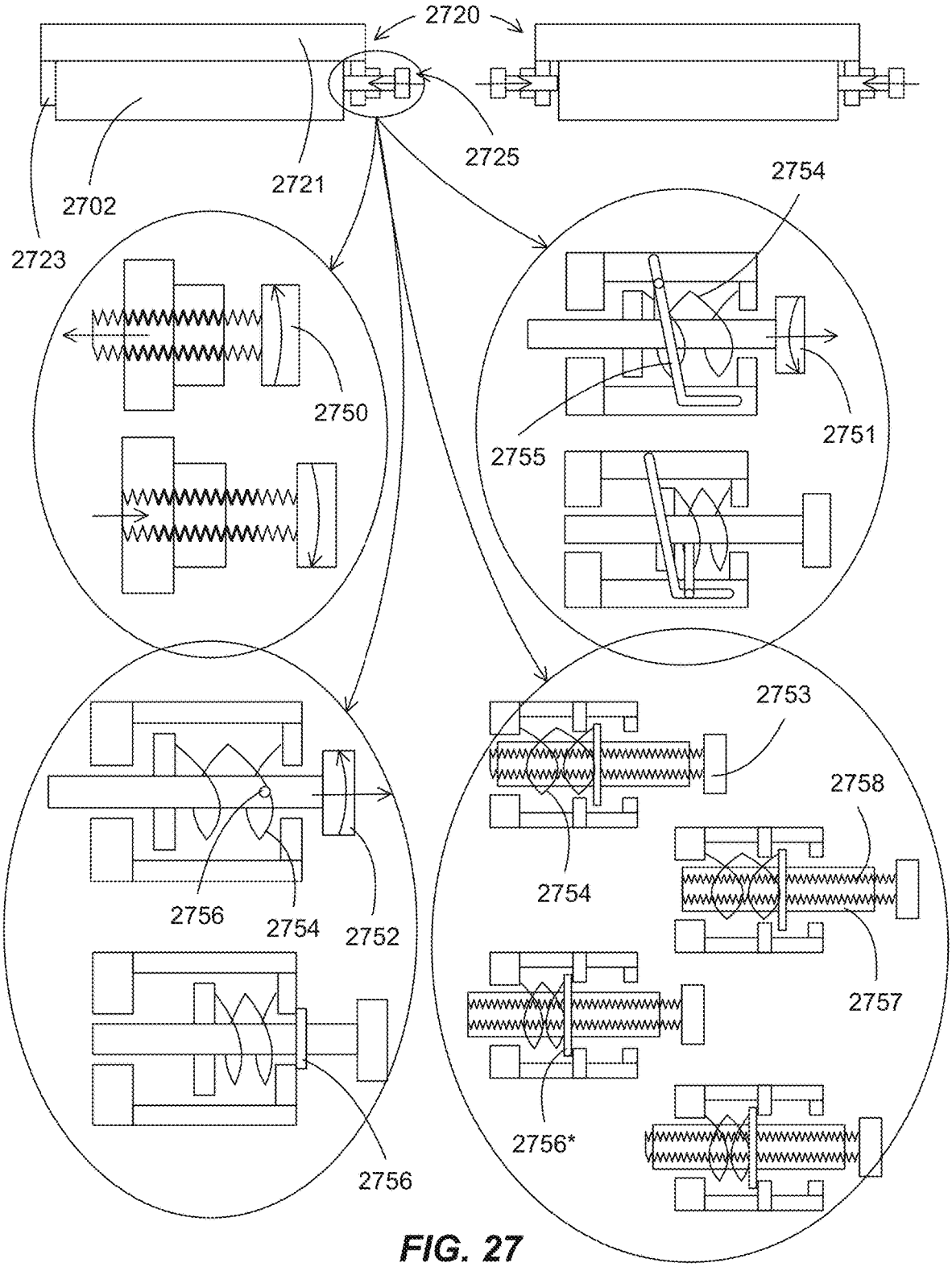
FIG. 27 illustrates configurations for plate assembly according to some embodiments.

FIG. 27 illustrates configurations for plate assembly according to some embodiments. A plate assembly 2720 can include side portions 1723 for attaching to a jaw 2702. Secure feature 2725 can be included on one side portion or one both side portions of the plate assembly 2720.

The secure feature 2725 can include a bolt 2750, for screwing on a nut element at the side portion. In the configuration of one sided secure feature, the bolts 2750 can move toward the jaw 2702, pushing the plate assembly against the other side portion. In the configuration of both sided secure feature, the bolts on both sides can move toward the jaw for contacting the jaw to secure the plate assembly with the jaw.

The secure feature 2725 can include a rod 2752, which can use a spring 2756 to push the rod toward the jaw. The rod can pull back, and rotate to be locked in a release position.

The secure feature 2725 can include a rod 2751, which can have a pin sliding on a spiral track 2755 for pushing the rod toward the jaw, against the side portion. Thus, when the rod 2751 rotates, the rod can advance toward the jaw. A spring 2754 can be used to assist the rod in pushing toward the jaw.

The secure feature 2725 can include a bolt 2758 rotatable in a rod 2757, for a coarse movement and a fine movement toward the jaw. In a coarse movement, the rod can be pushed toward the jaw, and secured in the push-in position. The coarse movement can be large, and might or might not push against the jaw. In a fine movement, the bolt can rotate to move toward the jaw to secure the plate assembly with the jaw.

FIGS. 28A-28B illustrate flow charts for plate assembly on a jaw according to some embodiments. In FIG. 28A, operation 2800 forms a plate assembly to be mounted on a jaw of a clamping device. The plate assembly can be secured on one or two sides of the jaw. The plate assembly can be secured by screw bolts to a side of the jaw. The plate assembly can be secured by a pin sliding in a spiral path to advance a rod against the side of the jaw. The plate assembly can be secured by a spring action. The plate assembly can be secured by a combination of a coarse movement and a fine movement. The plate assembly can be secured by a combination of a spring action and a screw action.

In FIG. 28B, operation 2820 releases a secure mechanism on a plate assembly. Operation 2830 mounts the plate assembly on a jaw. Operation 2840 activates the securing mechanism, in a coarse movement, to secure the plate assembly to the jaw. Operation 2850 activates the securing mechanism, in a fine movement, to secure the plate assembly to the jaw.

The plate assembly can include a mounting feature for another plate, e.g., for another plate to be attached to the plate assembly to increase the thickness of the plate. The plate of the plate assembly can be larger than the jaw, with the extended area is configured as a mounting feature for mounting the additional plates.

Figure 29B:
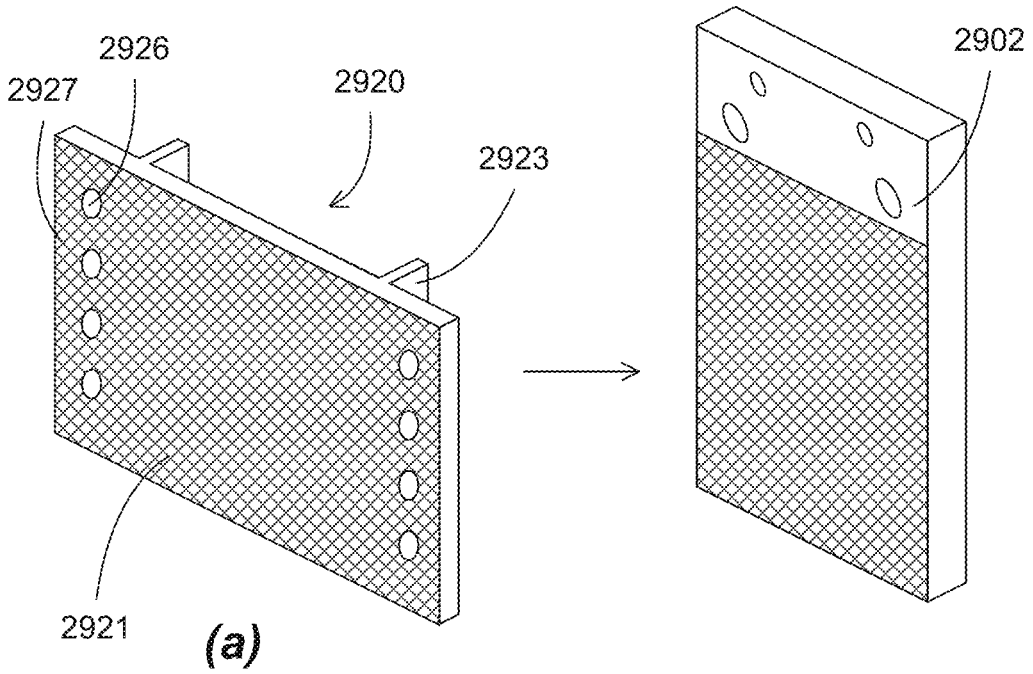
FIGS. 29A-29C illustrate a plate assembly having a mounting feature for additional plates according to some embodiments.
Figure 29A:
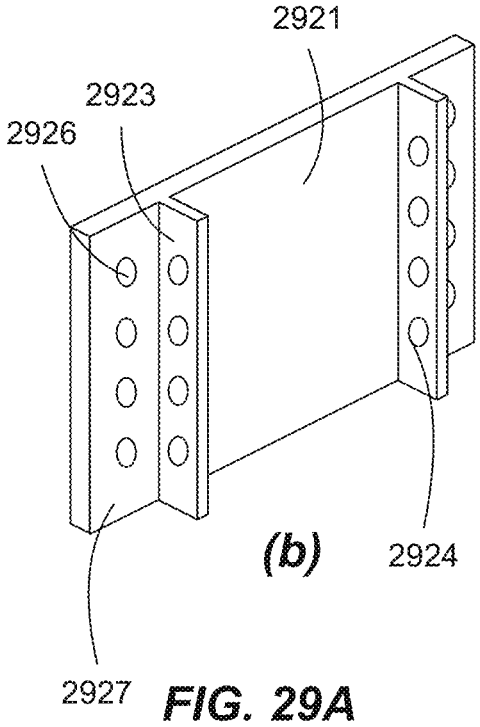
Figure 29C:
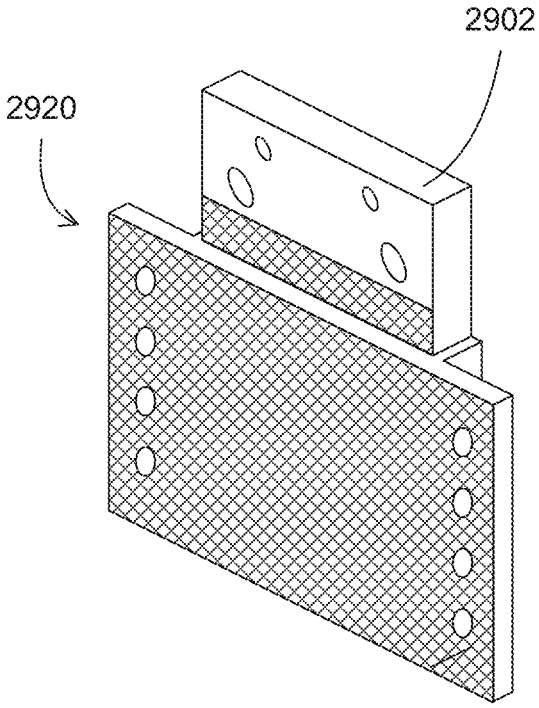

FIGS. 29A-29C illustrate a plate assembly having a mounting feature for additional plates according to some embodiments. In FIG. 29A, a plate assembly 2920 can include a plate 2921 and two side portions 2923. There can be secure features on the side portions 2923, such as coupled nuts 2924 to attaching bolts. The plate 2921 can be larger than the jaw 2902, which is defined by the side portions 2923. The extended area 2927 outside the jaw area can be configured for a mounting feature 2926 for additional plates without interference with the jaw.

In FIG. 29B, a jaw 2902 can be configured to mount the plate assembly 2920. In FIG. 29C, a plate assembly 2920 can be mounted on a jaw 2902 of a clamping device. Bolts can be used in the secure feature to secure the plate assembly to the jaw.

Figure 30A:
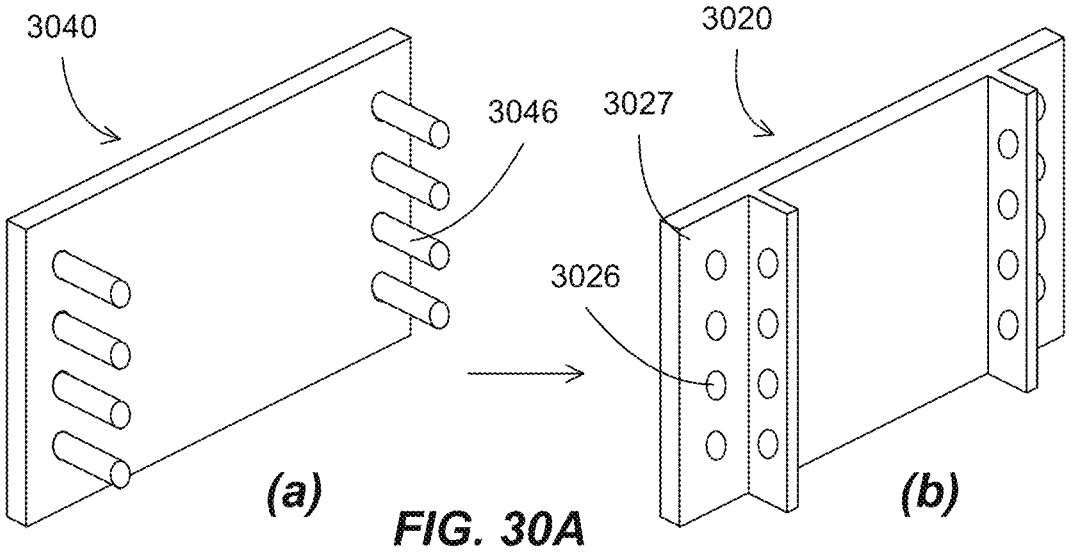
FIGS. 30A-30C illustrate a process for adding plates to a plate assembly according to some embodiments.
Figure 30B:
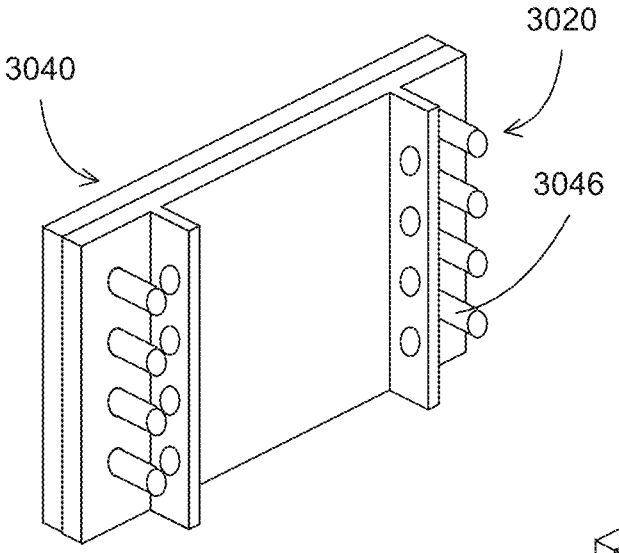
Figure 30C:
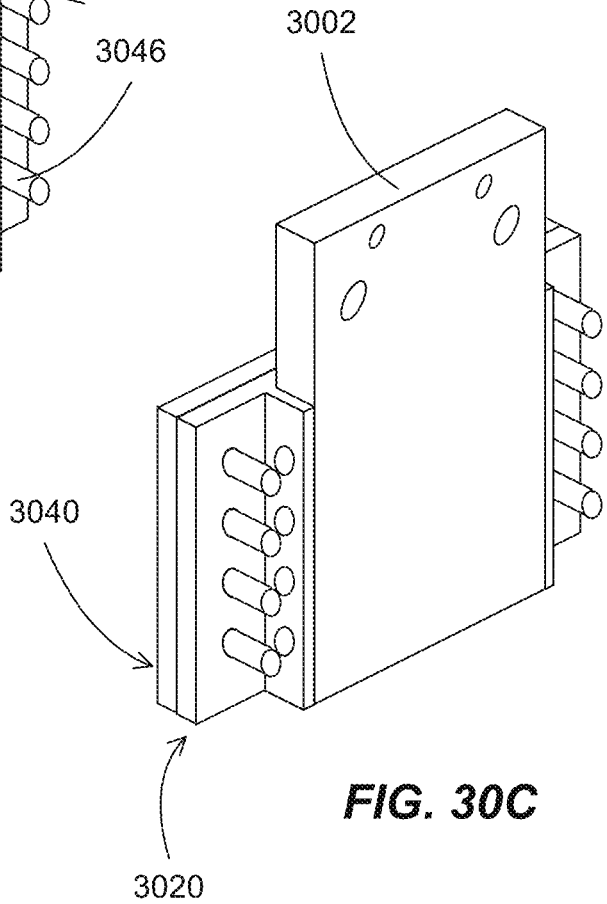

FIGS. 30A-30C illustrate a process for adding plates to a plate assembly according to some embodiments. FIG. 30A (*a*) shows an additional plate 3040 having a mounting feature in the form of multiple pins 3046 that can be mated to a corresponding mounting feature in a plate assembly 3020. FIG. 30A(*b*) shows the plate assembly 3020 having a mounting feature in the form of holes 3026 that can be mated with the pins 3046 from the additional plate 3040. FIG. 30B shows a composite plate assembly, with an additional plate 3040 mounted on a plate assembly 3020. FIG. 30C shows a jaw 3002 with the attached composite plate assembly.

Figure 31:
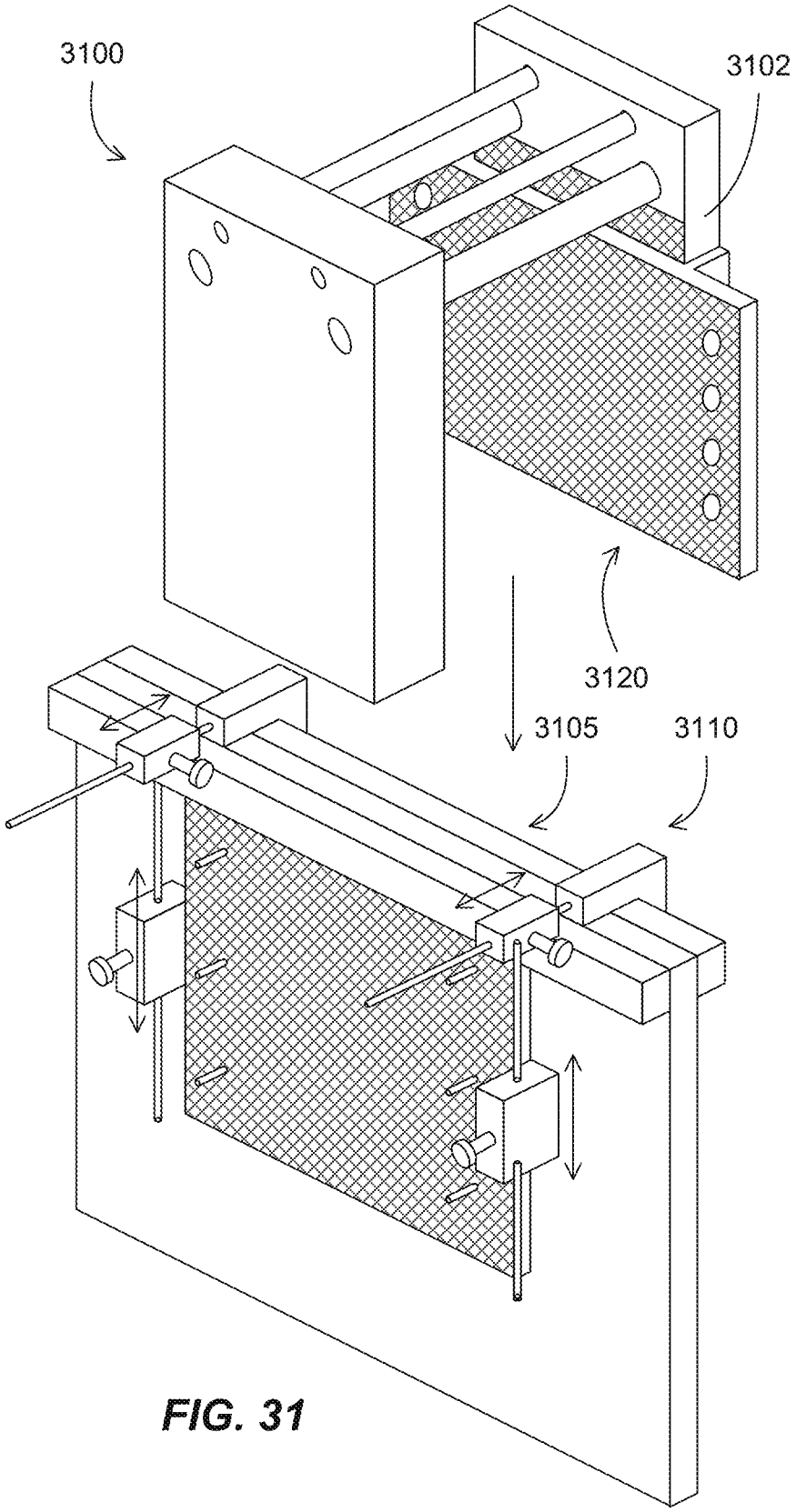
FIG. 31 illustrates a process for mounting a clamping device on a panel according to some embodiments.

FIG. 31 illustrates a process for mounting a clamping device on a panel according to some embodiments. The panel 3105 can have raised edge portions at both front and back sides of the panel. On the front side, a plate assembly 3110 for the object can be mounted to the panel. A plate assembly 3120 for the clamping device 3100 can be mounted on the jaw 3102 to compensate for the raised edge portion at the back side of the panel. The plate assembly 3120 can have a large plate, e.g., larger than the jaw area, for the option of mounting additional plates. Bolts can be used to secure the plate assembly 3120 to the jaw 3102.

Thus, the clamping device 3100 can contact the plate of the object plate assembly 3110 at the front side of the panel. At the back side, the plate of the jaw plate assembly 3120 at the jaw can contact the back side of the panel.

Figure 32:
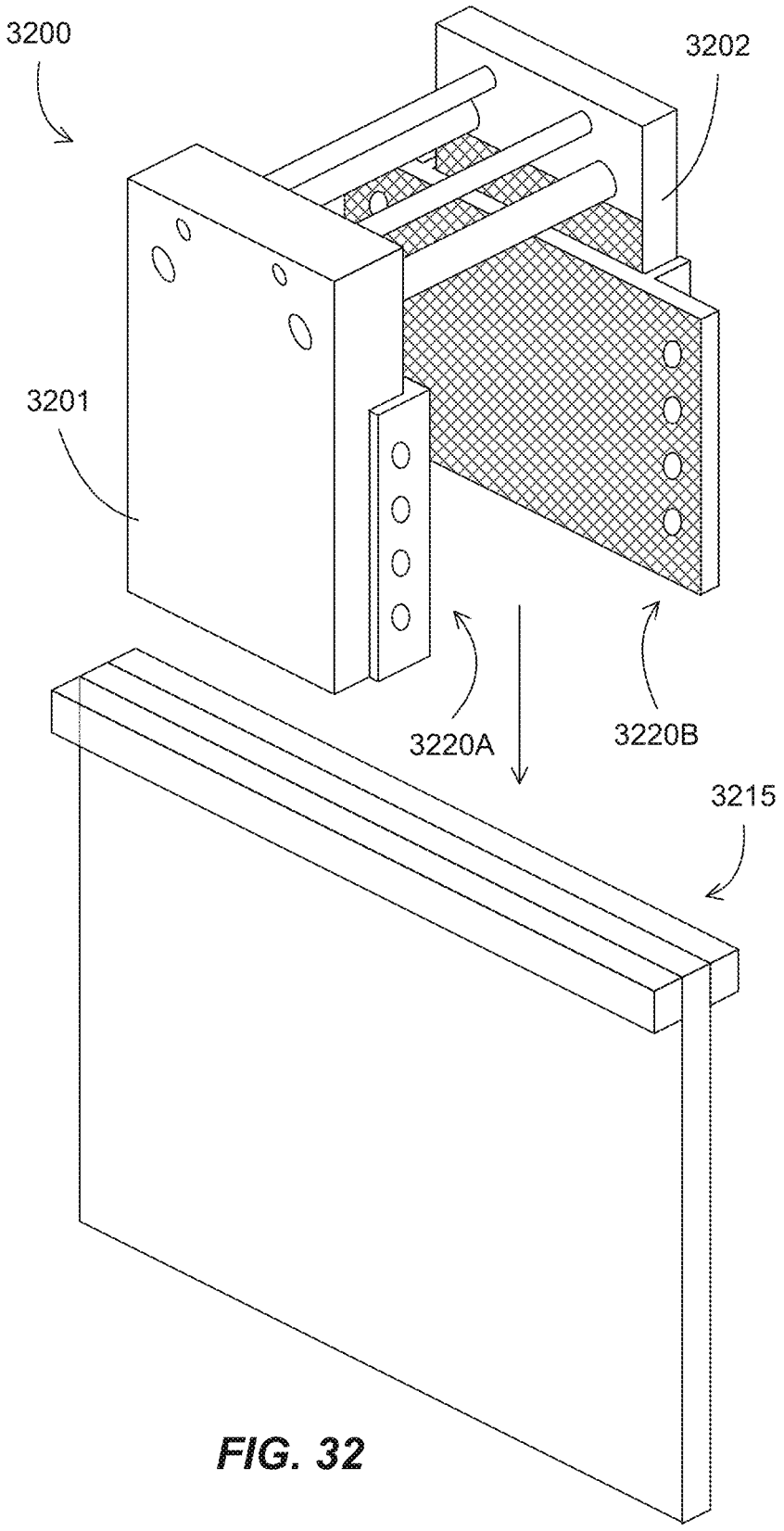
FIG. 32 illustrates a process for mounting a clamping device on a panel according to some embodiments.

FIG. 32 illustrates a process for mounting a clamping device on a panel according to some embodiments. The panel 3205 can have raised edge portions at both front and back sides of the panel. A plate assembly 3220A for the clamping device 3200 can be mounted on the jaw 3201 to compensate for the raised edge portion at the front side of the panel. Bolts can be used to secure the plate assembly 3220A to the jaw 3201. A second plate assembly 3220B for the clamping device 3200 can be mounted on the jaw 3202 to compensate for the raised edge portion at the back side of the panel. The plate assembly 3220B can have a large plate, e.g., larger than the jaw area, for the option of mounting additional plates. Bolts can be used to secure the plate assembly 3220B to the jaw 3202.

Thus, at the front side, the plate of the jaw plate assembly 3220A at the jaw 3201 can contact the front side of the panel. At the back side, the plate of the jaw plate assembly 3220B at the jaw 3202 can contact the back side of the panel.

Figure 33:
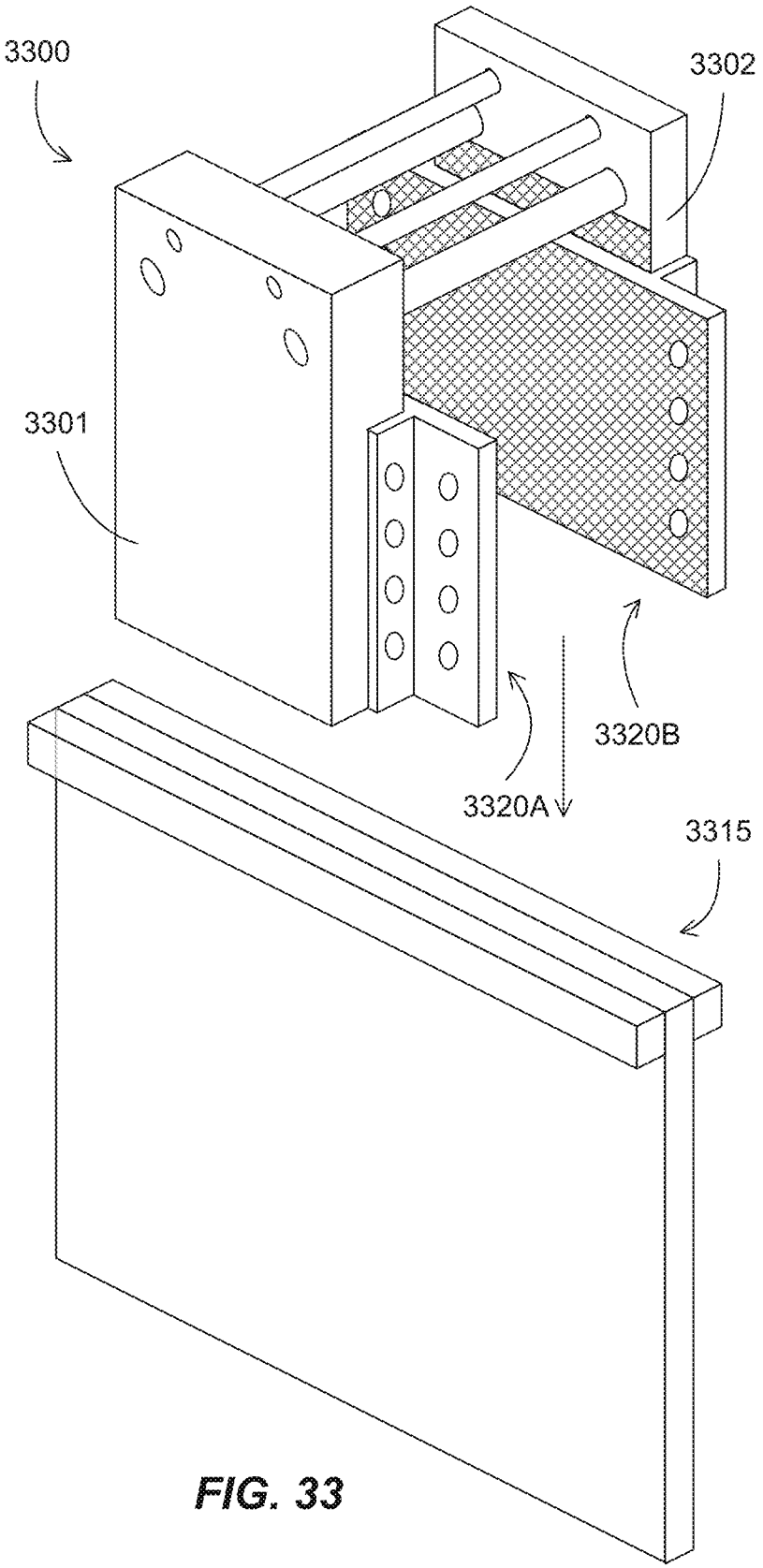
FIG. 33 illustrates a process for mounting a clamping device on a panel according to some embodiments.

FIG. 33 illustrates a process for mounting a clamping device on a panel according to some embodiments. The panel 3305 can have raised edge portions at both front and back sides of the panel. A plate assembly 3320A for the clamping device 3300 can be mounted on the jaw 3301 to compensate for the raised edge portion at the front side of the panel. The plate assembly 3320A can have a large plate, e.g., larger than the jaw area, for the option of mounting additional plates. Bolts can be used to secure the plate assembly 3320A to the jaw 3301. A second plate assembly 3320B for the clamping device 3300 can be mounted on the jaw 3302 to compensate for the raised edge portion at the back side of the panel. The plate assembly 3320B can have a large plate, e.g., larger than the jaw area, for the option of mounting additional plates. Bolts can be used to secure the plate assembly 3320B to the jaw 3302.

Figure 34A:
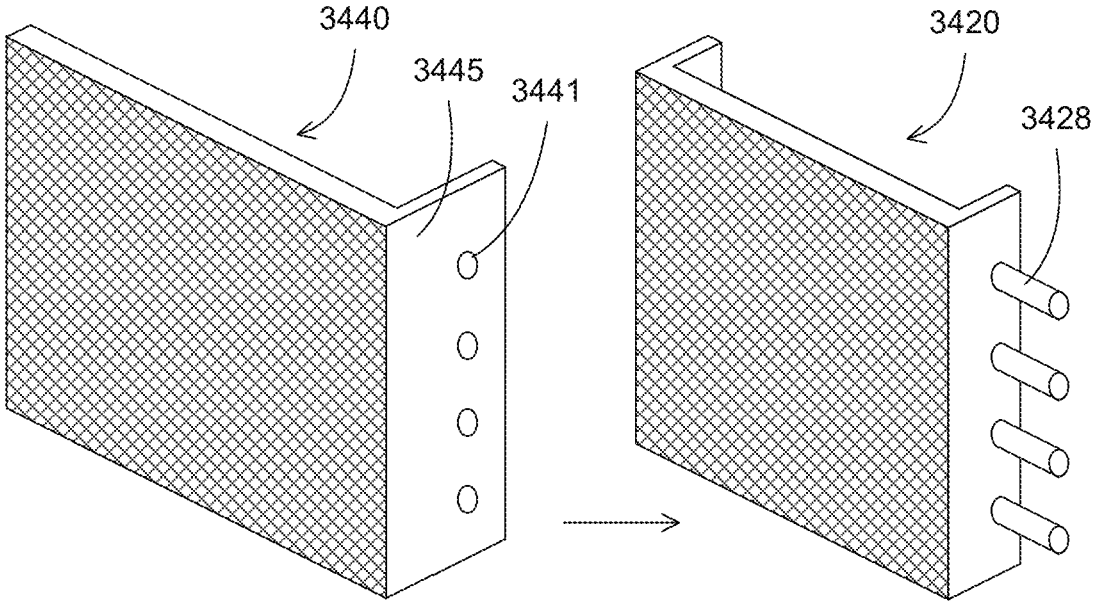
FIGS. 34A-34C illustrate a plate assembly having a mounting feature for additional plates according to some embodiments.
Figure 34B:
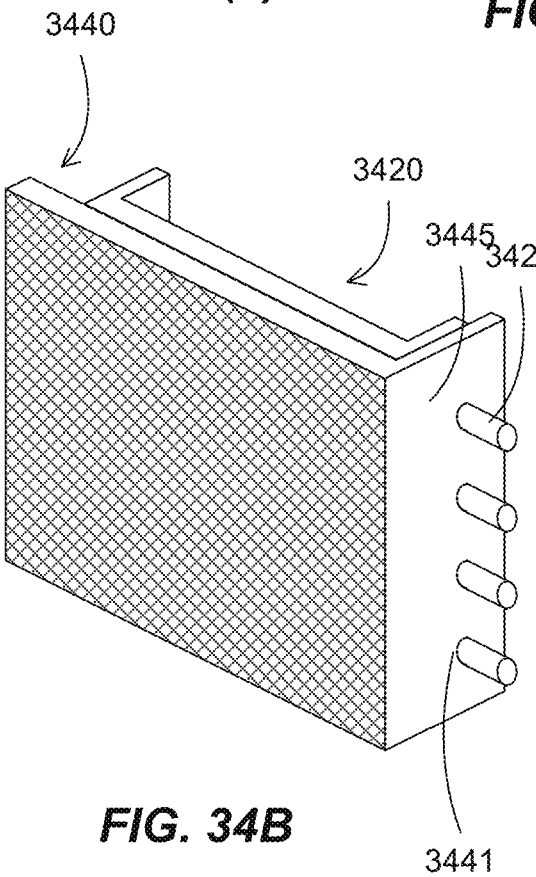
Figure 34C:
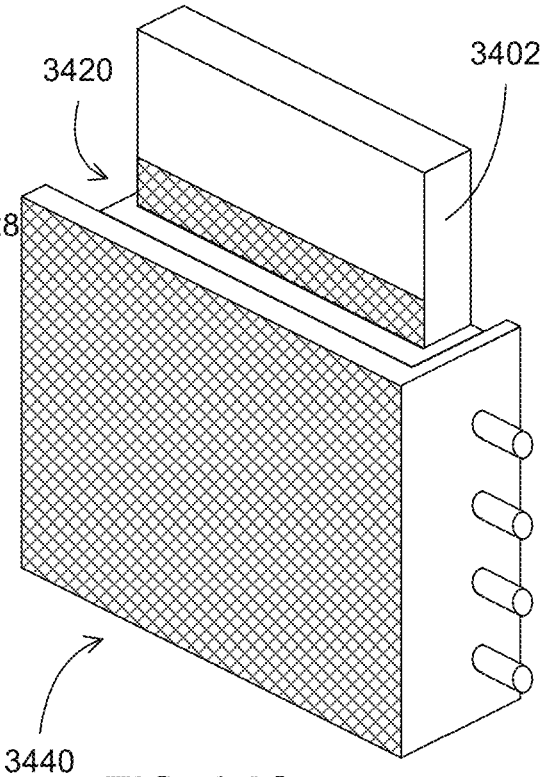

FIGS. 34A-34C illustrate a plate assembly having a mounting feature for additional plates according to some embodiments. In FIG. 34A(*a*), an additional plate 3440 can have a side portion 3445, with a mounting feature in the form of holes 3441 for mounting on a plate assembly 3420. The additional plate 3440 can be larger than the plate assembly 3420, with only one side portion 3445. FIG. 34A(*b*) shows the plate assembly 3420 having a corresponded mounting feature in the form of multiple pins 3428, which can mate with the holes 3441 in the additional plate 3440. FIG. 34B shows a composite plate assembly, with an additional plate 3440 mounted on a plate assembly 3420. FIG. 34C shows a jaw 3402 with the attached composite plate assembly.

FIGS. 35A-35C illustrate flow charts for configurations of plate assemblies according to some embodiments. In FIG. 35A, operation 3500 forms a plate assembly. The plate assembly comprises a plate coupled to a mounting feature. The mounting feature is configured to be mounted on a jaw of a clamping device configured to clamp on an object. The plate is extended outside the jaw surface. The extended portion of the plate is configured to accept one or more plates. The extended portion comprises multiple pins protruded toward the jaw or multiple holes. The one or more plates each comprises matching holes to be mated to the multiple pins or matching pins for the holes.

In FIG. 35B, operation 3520 mounts a plate assembly on a jaw of a clamping device for clamping on an object. Operation 3530 adds one or more plates to the plate assembly to increase a thickness to match with the thickness of the object.

In FIG. 35C, operation 3550 determines a thickness on an object for clamping. The thickness can be the height of the raised edge portion of the object. The thickness can be used to determine the plate assembly, or the additional plates needed to mount on the plate assembly. Operation 3560 mounts one or more plates on a plate assembly to match the thickness. Operation 3570 mounts the plate assembly on a jaw of a clamping device.

Figure 36A:
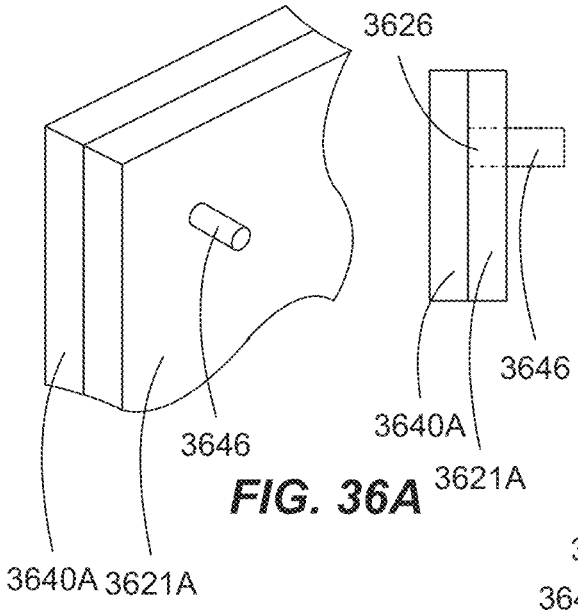
FIGS. 36A-36E illustrate configurations for coupling additional plates to a plate assembly according to some embodiments.
Figure 36B:
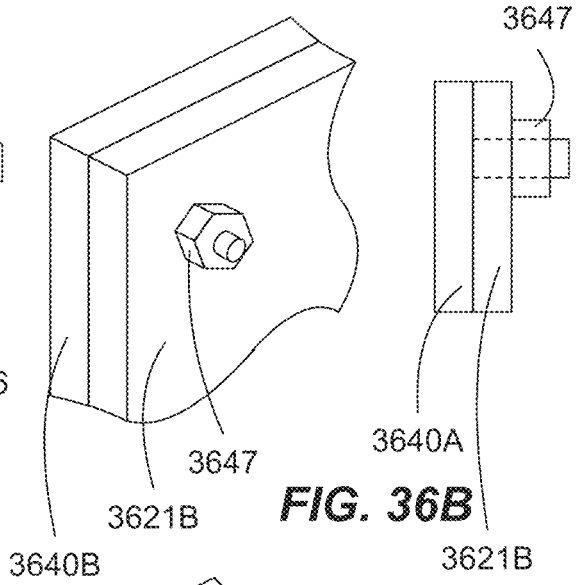
Figure 36C:
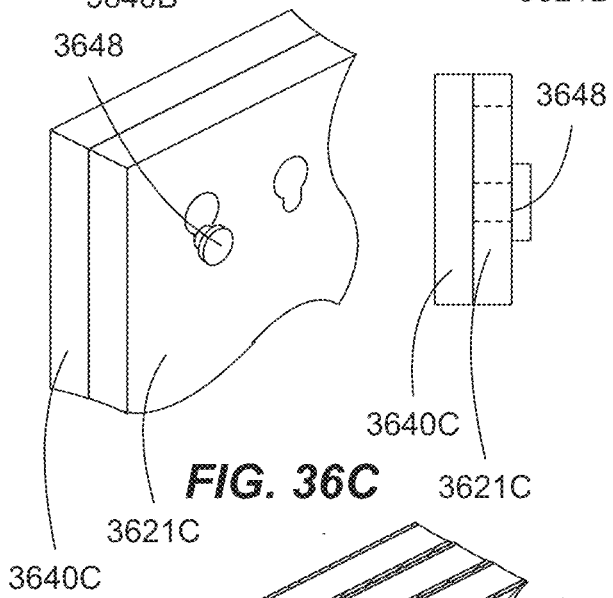
Figure 36E:
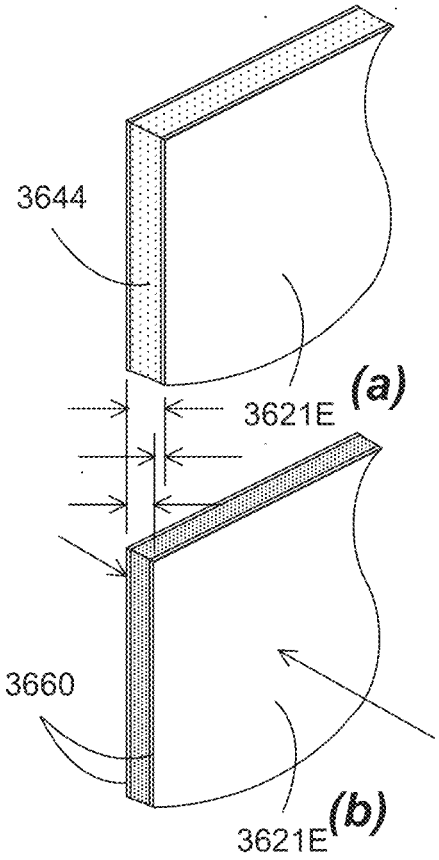
Figure 36D:
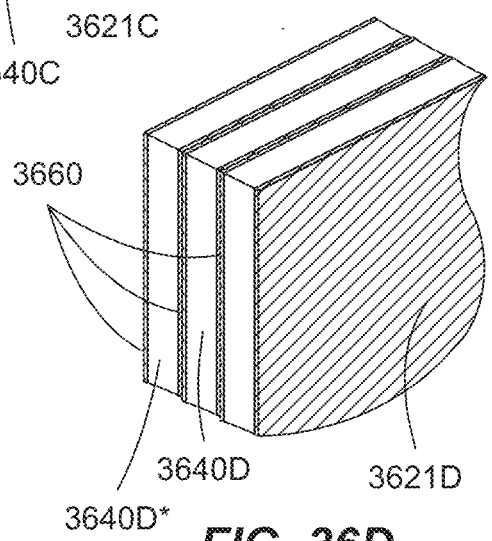

FIGS. 36A-36E illustrate configurations for coupling additional plates to a plate assembly according to some embodiments. In FIG. 36A, an additional plate 3640A can be coupled to a plate 3621A of a plate assembly. The additional plate 3640A can have pins 3646, to be mated with holes 3626 in the plate 3621A. In FIG. 36B, an additional plate 3640B can be coupled to a plate 3621B of a plate assembly. The additional plate 3640B can have bolts 3646, to be mated with holes in the plate 3621B, and secured by nuts 3647. In FIG. 36C, an additional plate 3640C can be coupled to a plate 3621C of a plate assembly. The additional plate 3640C can have sliding lock 3648, to be mated with sliding lock holes in the plate 3621C. The sliding lock can have a short smaller diameter rod connected to a larger diameter flare portion. The sliding lock hole can have a larger diameter hole (slightly larger than the flare portion) intercepting a smaller diameter hole (smaller than the flare portion and slightly larger than the rod). In operation, the flare portion enters the large hole, and slides toward the small hole for locking. In FIG. 36D, additional plates 3640D and 3640D*can be coupled to a plate 3621D of a plate assembly. The additional plates 3640D and 3640D*and the plate 3621D can all have a magnetic material for magnet attraction, such as a thin layer 3660 of magnetic material.

The plates, e.g. the plate coupled to the moving mechanism in a plate assembly or the additional plate to be coupled to the plate of the plate assembly, can be formed of a compressible material. FIG. 36E(*a*) shows a plate 3621E having a compressible material 3644, disposed between one or two layers 3660 of magnetic material for coupling to other plates.

FIGS. 37A-37C illustrate flow charts for configurations of plate assemblies according to some embodiments. In FIG. 37A, operation 3700 couples a plate to a plate assembly. The coupling can include one or more pins on the plate through corresponded holes in the plate assembly. The coupling can include one or more bolts on the plate through corresponded holes in the plate assembly with secured nuts. The coupling can include one or more hooks on the plate through corresponded receptacles in the plate assembly. The coupling can include magnet layers on the plate adhering to corresponded iron layers on the plate assembly. In FIG. 37B, operation 3720 couples a plate to a plate assembly to be coupled to a jaw of a clamping device or to an object. The plate assembly can include a plate. The plate can include a compressible material. In FIG. 37C, operation 3740 couples a plate to a plate assembly. The plate can include a compressible material.

In some embodiments, the clamping device can be formed, or an existing clamping device can be modified, to ease the mounting of a plate assembly on each one of the one or two jaws of the clamping device. For example, the jaws of the clamping device can have features to accept the mounting of the plate assembly.

Figure 38A:
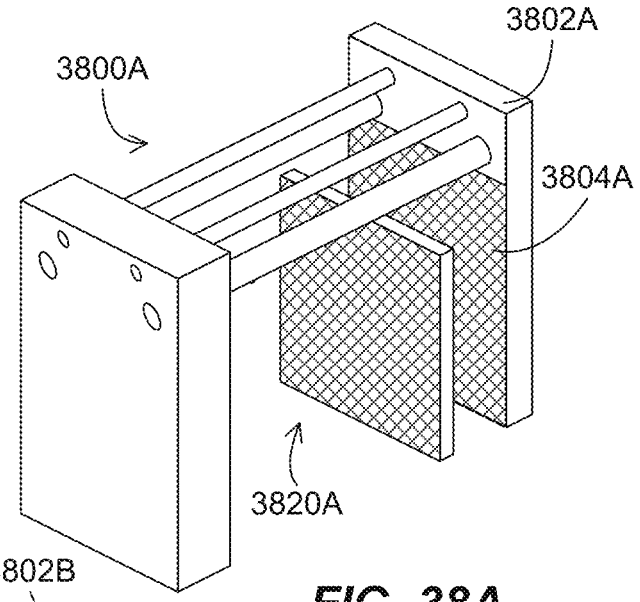
FIGS. 38A-38C illustrate configuration of clamping devices according to dome embodiments.
Figure 38B:
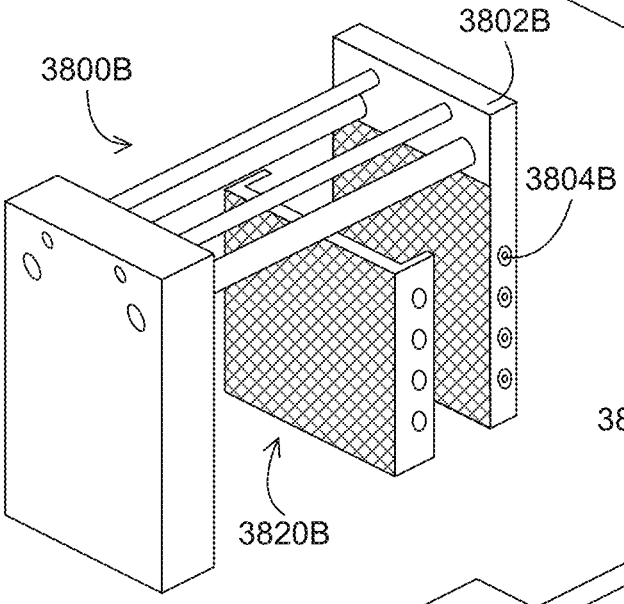
Figure 38C:
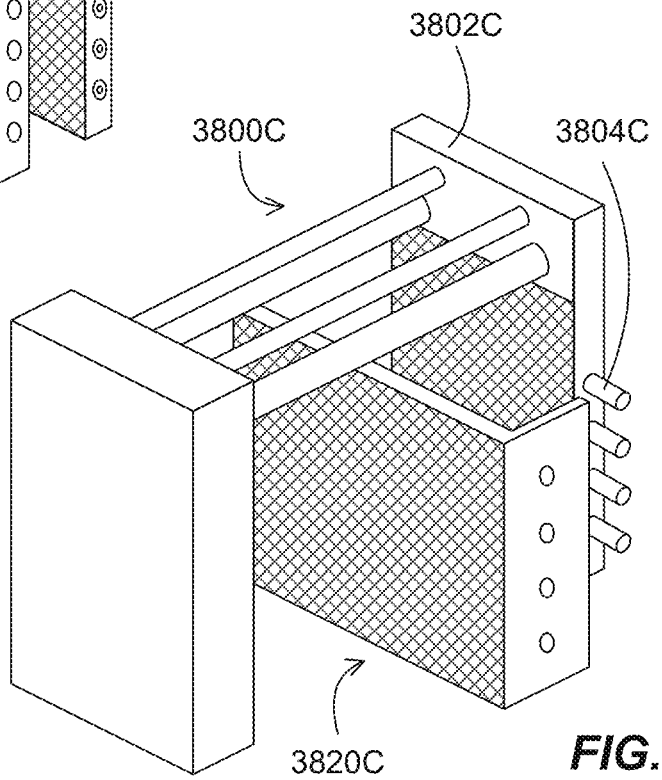

FIGS. 38A-38C illustrate configuration of clamping devices according to dome embodiments. The clamping device can be a newly fabricated clamping device with the mounting feature or an existing clamping device modified to have the mounting feature.

FIG. 38A shows a clamping device 3800A having a jaw 3802 having a magnetic layer 3804A disposed on a surface of the jaw 3802A. The magnetic material can be an iron-containing material, such as a layer or strips of steel or stainless steel on the jaw surface. The plate assembly 3820A can simply be a plate having a magnetic material on a surface facing the jaw. For example, the magnetic material in the plate can be a magnet layer or magnet bars, or magnet pieces. Thus, the magnetic material plate can be attached to the jaw with magnet force. The opposite surface of the plate can also contain a magnetic material, which can allow an attachment of an additional plate. Alternatively, the plate can be made of a magnetic material.

FIG. 38B shows a clamping device 3800B having a jaw 3802B having multiple holes 3804B disposed on side surfaces of the jaw 3802B. The holes can be mated with the holes or bolts of the plate assembly 3820B, so that the plate assembly can be mounted securely onto the jaw.

FIG. 38C shows a clamping device 3800C having a jaw 3802C having multiple pins 3804C disposed on a side surface of the jaw 3802C. The pins can be mated with the holes on the plate assembly 3820C, so that the plate assembly can be mounted onto the jaw.

FIGS. 39A-39C illustrate flow charts for configurations of a clamping device according to some embodiments. In FIG. 39A, operation 3900 modifies a jaw of a clamping device for coupling with a plate assembly. The modification can include forming multiple holes in a side of the jaw. The modification can include forming multiple pins in a side of the jaw In FIG. 39B, operation 3920 forms a clamping device having a jaw having a coupling feature for coupling with a plate assembly. The coupling feature can include multiple holes in a side of the jaw. The coupling feature can include multiple pins in a side of the jaw In FIG. 39C, operation 3940 forms a clamping device and an add-on feature having a plate assembly. The plate assembly can be configured to be coupled to a jaw of the clamping device. The plate assembly can include multiple holes in a side or in a face of a plate of the plate assembly. The plate assembly can include multiple pins in a side or in a face of a plate of the plate assembly.

What is claimed is:

1. An attachment for a clamping device,
wherein the clamping device comprises a first jaw facing a second jaw with the first and second jaw coupled to a jaw moving mechanism configured to move the first and second jaws for clamping on an object disposed between the first and second jaws,
the attachment comprising
a plate;
a mounting feature,
wherein the plate is coupled to the mounting feature through a first moving mechanism,
wherein the mounting feature is configured to be coupled to the object with the plate facing a surface of the object,
wherein the moving mechanism is configured to move the plate in a direction parallel to the surface and in a direction perpendicular to the surface,
wherein the attachment is configured, when coupled to the object, to compensate for an irregularity of the surface to increase a contact area with the first or second jaw of the clamping device when the clamping device clamps on the object.

2. An attachment as in claim 1,
wherein the plate comprises multiple pins configured to mount another plate.

3. An attachment as in claim 1,
wherein the plate comprises a layer comprising a compressible material or a deformable material.

4. An attachment as in claim 1,
wherein the plate comprises a layer comprising a compressible material or a deformable material,
wherein the layer comprises a thickness larger than the irregularity of the surface.

5. An attachment as in claim 1,
wherein the plate comprises a feature to configured to mount a second plate,
wherein the second plate comprises a compressible material or a deformable material.

6. An attachment as in claim 1,
wherein the first moving mechanism comprises a first linear guide configured to move the plate in the direction parallel to the surface,
wherein the first moving mechanism comprises a second linear guide configured to move the plate in the direction perpendicular to the surface.

7. An attachment as in claim 1,
wherein the first moving mechanism comprises a first block sliding along a first rod for moving the plate in the direction parallel to the surface,
wherein the first moving mechanism comprises a second block sliding along a second roc for moving the plate in the direction perpendicular to the surface.

8. An attachment as in claim 1,
wherein the first moving mechanism comprises an anti-rotation feature to prevent the plate from rotating around a direction parallel to the surface.

9. An attachment as in claim 1, further comprising
a second plate,
wherein the second plate is coupled to the mounting feature through a second moving mechanism,
wherein the second plate faces a second surface of the object,
wherein the second moving mechanism is configured to move the second plate in a direction parallel to the surface and in a direction perpendicular to the surface.

10. An attachment for a clamping device comprising
a plate;
a mounting feature,
wherein the plate is coupled to the mounting feature,
wherein the mounting feature is configured to be coupled to a jaw of the clamping device with the plate facing a surface of the jaw,
wherein the mounting feature is configured to secure the plate to at least a side of the jaw,
wherein at least one of
the mounting feature comprises screw bolts to secure the plate assembly to the at least a side of the jaw,
the mounting feature comprises a pin sliding in a spiral path to advance a rod against the at least a side of the jaw to secure the plate assembly,
the mounting feature comprises a spring action to secure the plate assembly,
the mounting feature comprises a combination of a coarse movement and a fine movement to secure the plate assembly, or
the mounting feature comprises a combination of a spring action and a screw action to secure the plate assembly,
wherein the attachment is configured, when coupled to the jaw, to compensate for an irregularity of a surface of an object to increase a contact area between the object and the clamping device.

11. An attachment as in claim 10,
wherein the plate is extended outside the jaw surface.

12. An attachment as in claim 10,
wherein the plate is extended outside the jaw surface,
wherein the extended portion of the plate is configured to accept one or more plates.

13. An attachment as in claim 10,
wherein the plate is extended outside the jaw surface,
wherein the extended portion comprises multiple pins protruded toward the jaw or comprises multiple holes.

14. An attachment as in claim 10,
wherein the plate is extended outside the jaw surface,
wherein the extended portion comprises multiple pins protruded toward the jaw or comprises multiple holes,
wherein the extended portion of the plate is configured to accept one or more plates,
wherein the one or more plates each comprises matching holes to be mated to the multiple pins or comprises matching pins for the multiple holes.

15. An attachment as in claim 10,
an attachment feature disposed on the plate or on the mounting feature,
wherein the attachment feature is configured to couple one or more second plates to the plate.

16. An attachment as in claim 10, further comprising
an attachment feature disposed on the plate or on the mounting feature,
wherein at least one of
the attachment feature comprises one or more pins on the plate, wherein the one or more pins are configured to couple to one or more second plates through corresponding holes in the one or more second plates;

the attachment feature comprises one or more bolts on the plate, wherein the one or more pins are configured to couple to one or more second plates through corresponding holes in the one or more second plates with secured nuts;

the attachment feature comprises one or more sliding locks on the plate, wherein the one or more sliding locks are configured to couple to one or more second plates through corresponding receptacles in the one or more second plates; or the attachment feature comprises magnet layers on the plate, wherein the magnet layers are configured to couple to one or more second plates by adhering to corresponding iron layers in the one or more second plates.

17. An attachment as in claim 10, wherein the plate comprises a feature configured to increase a thickness of the plate.

18. An attachment as in claim 10, wherein the plate comprises a feature to configured to mount a secured plate, wherein the second plate comprises a compressible material or a deformable material.

19. An attachment for a clamping device, wherein the clamping device comprises a first jaw facing a second jaw with the first and second jaw coupled to a jaw moving mechanism configured to move the first and second jaws for clamping on an object disposed between the first and second jaws, the attachment comprising a first attachment comprising a first plate;

a first mounting feature, wherein the first plate is coupled to the first mounting feature through a moving mechanism, wherein the first mounting feature is configured to be coupled to the object with the first plate facing a surface of the object, wherein the moving mechanism is configured to move the first plate in a direction parallel to the surface of the object and in a direction perpendicular to the surface of the object;

a second attachment comprising a second plate;

a second mounting feature, wherein the second plate is coupled to the second mounting feature, wherein the second mounting feature is configured to be coupled to a jaw of the first or second jaws of the clamping device with the second plate facing a surface of the jaw, wherein the second mounting feature is configured to secure the second plate to at least a side of the jaw, wherein the first and second attachments are configured to compensate for an irregularity of the surface of the object to increase a contact area between the object and the first and second jaws of the clamping device when the clamping device clamps on the object.

* * * * *